US005343846A

United States Patent [19]

Ogawa et al.

[11] Patent Number: 5,343,846

[45] Date of Patent: Sep. 6, 1994

[54] CONTROL SYSTEM FOR INTERNAL COMBUSTION ENGINES

[75] Inventors: Ken Ogawa; Yoshikazu Oshima, both of Wako, Japan

[73] Assignee: Honda Giken Kogyo Kabushiki Kaisha, Tokyo, Japan

[21] Appl. No.: 156,070

[22] Filed: Nov. 23, 1993

[30] Foreign Application Priority Data

Nov. 26, 1992 [JP] Japan ..... 4-339849

[51] Int. Cl.[5] ..... F02M 33/02; F02D 41/04

[52] U.S. Cl. ..... 123/520; 123/700

[58] Field of Search ..... 123/518, 519, 520, 700, 123/698, 585

[56] References Cited

U.S. PATENT DOCUMENTS

| | | | |
|---|---|---|---|
| 4,537,172 | 8/1985 | Kanehara et al. | 123/527 |
| 4,763,265 | 8/1988 | Kawanabe et al. | 123/700 |
| 5,209,214 | 5/1993 | Ikuta et al. | 123/698 |
| 5,216,991 | 6/1993 | Iida et al. | 123/520 |
| 5,216,995 | 6/1993 | Hosoda et al. | 123/520 |
| 5,216,997 | 6/1993 | Osanai et al. | 123/698 |
| 5,216,998 | 6/1993 | Hosoda et al. | 123/520 |
| 5,237,979 | 8/1993 | Hyodo et al. | 123/520 |
| 5,257,613 | 11/1993 | Monda et al. | 123/698 |

FOREIGN PATENT DOCUMENTS

| | | |
|---|---|---|
| 61-277837 | 12/1986 | Japan . |
| 62-3147 | 1/1987 | Japan . |

*Primary Examiner*—Carl S. Miller
*Assistant Examiner*—Thomas N. Moulis
*Attorney, Agent, or Firm*—Nikaido, Marmelstein, Murray & Oram

[57] ABSTRACT

A control system for an internal combustion engine controls an amount of auxiliary air supplied to the engine in the following manner: Concentration of evaporative fuel contained in a gas purged from an evaporative emission control system into an intake passage of the engine is calculated based on a purging flow rate estimated based on operating conditions of the engine, and an output from a flowmeter arranged in the evaporative emission control system. A volume of the gas purged over a predetermined time period is calculated based on the output from the flowmeter. A parameter indicative of dynamic characteristics of the gas is calculated based on operating conditions of the engine. An amount of air contained in the purged gas drawn into a combustion chamber of the engine is calculated at least based on the concentration of evaporative fuel, the volume of the purged gas, and the parameter indicative of dynamic characteristics of the gas. The amount of auxiliary air supplied to the engine is controlled in a manner dependent on the amount of air contained in the purged gas.

12 Claims, 31 Drawing Sheets

CYL SIGNAL PULSE
TDC SIGNAL PULSE
CRK SIGNAL PULSE (#1CYL STAGE NUMBER)
SINJ(k)
FUEL INJECTION VALVE
OPEN
CLOSE
90°
180°
30°
CRME
#7
#8
#9
#10
#11
#12
#13
#14
#15
#16
#17
#18
#19
#20
#21
#22
#23
#0
#1
#2
#3
0
1
2
3
0
#1 EXHAUST STROKE
#1 SUCTION STROKE
#1 COMPRESSION STROKE
#1 EXPLOSION STROKE
C1

FIG.7

QVAPER DETERMINATION

- READ INFORMATION ON VARIOUS ENGINE OPERATING PARAMETERS (S51)
- LPACT=LPLIFT−LP0 (S52)
- VHACT=VHW−VHW0 (S53)
- DETERMINE QBEM BY QBE MAP (S54)
- DETERMINE QHW BY QHW TABLE (S55)
- DETERMINE KTP BY KTP TABLE (S56)
- DETERMINE KPAP BY KPAP TABLE (S57)
- QBE=QBEM×KTP×KPAP (S58)
- KQ=QHW/QBE (S59)
- DETERMINE CBU BY CBU TABLE (S60)
- QHWD=QHW×ME (S61)
- →RETURN

FIG.8

| | LPACT00 | ····· | LPACT15 |
|---|---|---|---|
| PBG00 | QBEM(00,00) | ····· | QBEM(00,15) |
| ⋮ | ⋮ | ⋱ | ⋮ |
| PBG15 | QBEM(15,00) | ····· | QBEM(15,15) |

FIG.14

| | ME0 | ····· | ME7 |
|---|---|---|---|
| PBA0 | $\tau$ p(0,0) | ····· | $\tau$ p(0,7) |
| ⋮ | ⋮ | ⋱ | ⋮ |
| PBA7 | $\tau$ p(7,0) | ····· | $\tau$ p(7,7) |

*FIG.15*

| | ME0 | ⋯ | ME7 |
|---|---|---|---|
| PBA0 | Ba(0,0) | ⋯ | Ba(0,7) |
| ⋮ | ⋮ | ⋱ | ⋮ |
| PBA7 | Ba(7,0) | ⋯ | Ba(7,7) |

*FIG.16*

| | ME0 | ⋯ | ME7 |
|---|---|---|---|
| PBA0 | Bb(0,0) | ⋯ | Bb(0,7) |
| ⋮ | ⋮ | ⋱ | ⋮ |
| PBA7 | Bb(7,0) | ⋯ | Bb(7,7) |

*FIG.18*

GAIRP DETERMINATION

READ QHWD($\tau$ p),CBU($\tau$ p) (S101)

CA($\tau$ p) = 1−CBU($\tau$ p) (S102)

GAIRP = QHWD($\tau$ p)×CA($\tau$ p)×KTP (S103)

→RETURN

*FIG.20*

| | ME00 | ..... | ME19 |
|---|---|---|---|
| PBA00 | KPUM(00,00) | ..... | KPUM(00,19) |
| ⋮ | ⋮ | ⋱ | ⋮ |
| PBA16 | KPUM(16,00) | ..... | KPUM(16,19) |

*FIG.27*

| | QPUCMD00 | ..... | QPUCMD15 |
|---|---|---|---|
| PBA00 | LPUCMD (00,00) | ..... | LPUCMD (15,00) |
| ⋮ | ⋮ | ⋱ | ⋮ |
| PBA15 | LPUCMD (00,15) | ..... | LPUCMD (15,15) |

FIG.25

LPUCMD DETERMINATION

- ΔVH=VHCMD−VHACT (S131)
- (IF: ΔVH<0) (S132)
  - [THEN]
  - RETRIEVE KVPD,KVID,KVDD (S133)
  - VHP(n)=ΔVH(n)×KVPD (S134)
  - VHI(n)=ΔVH(n)×KVID×VHI(n−1) (S135)
  - VHD(n)=(ΔVH(n)−ΔVH(n−1))×KVID (S136)
  - [ELSE]
  - RETRIEVE KVPU,KVIU,KVDU (S137)
  - VHP(n)=ΔVH(n)×KVPU (S138)
  - VHI(n)=ΔVH(n)×KVIU×VHI(n−1) (S139)
  - VHD(n)=(ΔVH(n)−ΔVH(n−1))×KVIU (S140)
- VHOBJ(n)=VHP(n)+VHI(n)+VHD(n) (S141)
- DETERMINE QPUCMD BY QPUCMD TABLE (S142)
- DETERMINE LPUCMD BY LPUCMD TABLE (S143)
- →RETURN

*FIG.30*

| | TW0 | ⋯ | TW6 |
|---|---|---|---|
| PBA0 | A(0,0) | ⋯ | A(0,6) |
| ⋮ | ⋮ | ⋱ | ⋮ |
| PBA6 | A(6,0) | ⋯ | A(6,6) |

*FIG.31*

| | TW0 | ⋯ | TW6 |
|---|---|---|---|
| PBA0 | B(0,0) | ⋯ | B(0,6) |
| ⋮ | ⋮ | ⋱ | ⋮ |
| PBA6 | B(6,0) | ⋯ | B(6,6) |

FIG.34

| | KEGR0 | ⋯⋯⋯⋯ | KEGR4 |
|---|---|---|---|
| PBA0 | KEA(0,0) | ⋯⋯⋯⋯ | KEA(0,4) |
| ⋮ | ⋮ | ⋱ | ⋮ |
| PBA6 | KEA(6,0) | ⋯⋯⋯⋯ | KEA(6,4) |

FIG.35

| | KEGR0 | ⋯⋯⋯⋯ | KEGR4 |
|---|---|---|---|
| PBA0 | KEB(0,0) | ⋯⋯⋯⋯ | KEB(0,4) |
| ⋮ | ⋮ | ⋱ | ⋮ |
| PBA6 | KEB(6,0) | ⋯⋯⋯⋯ | KEB(6,4) |

CONTROL SYSTEM FOR INTERNAL COMBUSTION ENGINES

BACKGROUND OF THE INVENTION

1. Field of the Invention

This invention relates to a control system for internal combustion engines, and more particularly to a control system for an internal combustion engine equipped with an evaporative emission control system for purging (discharging) evaporative fuel generated from a fuel tank into an intake system of the engine to thereby control the emission of evaporative fuel into the air.

2. Prior Art

Conventionally, a control system for an internal combustion engine has been proposed, e.g. by U.S. Pat. No. 4,537,172, filed Oct. 21, 1983 (hereinafter referred to as "the first prior art system"), which comprises a fuel tank, a canister for adsorbing evaporative fuel generated from the fuel tank to temporarily store it therein, a purging passage connecting between the canister and an intake system of the engine, a flowmeter arranged in the purging passage for measuring a flow rate of a purged gas (mixture of evaporative fuel and air), and a purge control valve arranged in the purging passage at a location downstream of the flowmeter for controlling the flow rate of purged gas.

According to the first prior art system, evaporative fuel generated from the fuel tank is temporarily stored in the canister, and the stored evaporative fuel is purged into the intake system of the engine as a fuel component for combustion to be burned in a combustion chamber of the engine together with fuel injected by a fuel injection valve. Further, according to this system, the flow rate of purged gas is controlled by means of the purge control valve arranged in the purging passage so as to control the air-fuel ratio of a mixture supplied to the combustion chamber to a desired value, to thereby prevent the emission of noxious components from the engine into the atmosphere.

Further, an idling intake air control device for controlling an amount of intake air to be supplied to the engine during idling has also been proposed e.g. by Japanese Provisional Patent Publication (Kokai) No. 62-3147 (hereinafter referred to as "the second prior art system"), which comprises a bypass passage bypassing a throttle valve arranged in the intake passage and an auxiliary air control valve arranged in the bypass passage, for supplying a required amount of air to the engine even during deceleration toward idling, to control the rotational speed of the engine to a desired idling speed promptly and in a suitable manner.

According to the second prior art system, the auxiliary air control valve is controlled in a feedback manner such that an actual value of the rotational speed of the engine becomes equal to the desired idling speed, whereby the optimum amount of auxiliary intake air is supplied to the engine, so as to enhance convergence of the idling speed, thereby preventing a drop of the idling speed and engine stall.

Further, an internal combustion engine has already been proposed e.g. by Japanese Provisional Patent Publication (Kokai) No. 61-277837 (hereinafter referred to as "the third prior art system"), which is equipped with a fast idle device for increasing the idling speed to prevent engine stall when the engine temperature is low.

According to the third prior art system, a sensor, such as a thermistor, detects an engine coolant temperature, and when the engine coolant temperature is not higher than a predetermined value (e.g. 70° C.), auxiliary air is supplied to the engine to properly control the engine rotational speed for prevention of engine stall.

In the first prior art system, however, the flow rate of evaporative fuel contained in the purged gas varies as a function of the amount of fuel stored in the canister. It is difficult to estimate the amount of evaporative fuel stored in the canister, and hence it is impossible to calculate an accurate amount of purged evaporative fuel, so that even if the flow rate of purged evaporative fuel is controlled by means of the control valve, it is impossible to accurately control the flow rate of purged evaporative fuel.

Therefore, if the second prior art system or the third prior art system is incorporated in the first prior art system and a large amount of evaporative fuel is purged into the intake passage during idling of the engine, air contained in the purged gas is supplied to the engine in addition to auxiliary air from the auxiliary air control valve or the fast idling device, so that the engine rotational speed is increased to an undesired level, resulting in degraded performance of the engine during idling.

Further, as described hereinabove, in the first prior art system, the flow rate of the purged evaporative fuel cannot be accurately calculated, so that if a large amount of evaporative fuel is drawn into the combustion chamber, the air-fuel ratio of a mixture deviates from a desired value, resulting in degraded exhaust emission characteristics.

SUMMARY OF THE INVENTION

It is the object of the invention to provide a control system for an internal combustion engine, which is capable of preventing engine performance from being degraded even if a large amount of evaporative fuel is purged from a canister into the engine during idling.

To attain the above object, the present invention provides a control system for an internal combustion engine having an intake passage having an inner wall surface, a fuel tank, at least one fuel injection valve, at least one combustion chamber, and an evaporative emission control system, the evaporative emission control system including a canister for adsorbing evaporative fuel generated from the fuel tank, a purging passage connecting between the intake passage and the canister, a flowmeter arranged in the purging passage for generating an output indicative of a flow rate of a gas containing the evaporative fuel and purged through the purging passage into the intake passage, and a purge control valve for controlling the flow rate of the gas.

The control system according to the invention is characterized by comprising:

- auxiliary air supply means for supplying auxiliary air to the engine,
- operating condition-detecting means for detecting operating conditions of the engine including at least the rotational speed of the engine and load on the engine;
- purging flow rate-calculating means for calculating a value of the flow rate of the gas based on results of detection by the operating condition-detecting means;
- concentration-calculating means for calculating concentration of evaporative fuel contained in the gas based on a result of calculation by the purging flow rate-calculating means and the output from the flowmeter;

purged gas volume-calculating means for calculating a volume of the gas purged over a predetermined time period, based on the output from the flowmeter;

purged gas dynamic characteristic-determining means for calculating a parameter indicative of dynamic characteristics of the gas based on a result of detection by the operating condition-detecting means;

purged air amount-calculating means for calculating an amount of air contained in the purged gas drawn into the combustion chamber during the present cycle of operation of the engine, at least based on a result of calculation by the concentration-calculating means, a result of calculation by the purged gas volume-calculating means, and a result of calculation by the purged gas dynamic characteristic-determining means; and auxiliary air amount control means for controlling an amount of auxiliary air supplied by the auxiliary air supply means depending on a result of calculation by the purged air amount-calculating means.

Preferably, the auxiliary air amount control means comprises a control valve arranged in the auxiliary air supply means and controlled based on a parameter indicative of the amount of auxiliary air, for controlling the amount of auxiliary air, basic value-determining means for determining a basic value of the parameter based on a desired idling engine rotational speed, subtraction value-determining means for determining a value of the parameter to be subtracted from the basic value of the parameter based on the amount of air contained in the purged gas calculated by the purged gas amount-calculating means, and parameter-calculating means for calculating the parameter by subtracting the subtraction value of the parameter from the basic value of the parameter.

Also preferably, the control system includes first evaporative fuel amount-calculating means for calculating a total amount of evaporative fuel purged from the canister into the intake passage during a present cycle of operation of the engine, based on the result of calculation by the purged gas dynamic characteristics-calculating means and the result of calculation by the concentration-calculating means, second evaporative fuel amount-calculating means for calculating an amount of evaporative fuel supplied to the combustion chamber of the engine during the present cycle of operation of the engine based on the total amount of evaporative fuel calculated by the first evaporative fuel amount-calculating means and the parameter indicative of the dynamic characteristics of the gas calculated by the purged gas dynamic characteristic-calculating means, required fuel amount-determining means for determining an amount of fuel to be injected by each of the at least one fuel injection valve based on a result of calculation by the second evaporative fuel amount-calculating means.

Also preferably, the purged gas dynamic characteristic-calculating means includes delay time-calculating means for calculating a delay time required for the evaporative fuel purged from the canister to reach the combustion chamber after leaving the canister, direct evaporative fuel supply amount-calculating means for estimating an amount of evaporative fuel directly supplied to the combustion chamber, out of an amount of evaporative fuel purged into the intake passage during the present cycle of operation of the engine, and carry-off evaporative fuel supply amount-calculating means for estimating an amount of evaporative fuel carried off from evaporative fuel staying in the purging passage and the intake passage into the combustion chamber during the present cycle of operation of the engine.

More preferably, the direct evaporative fuel supply amount-calculating means and the carry-off evaporative fuel supply amount-calculating means estimate, respectively, the amount of evaporative fuel directly supplied to the combustion and the amount of evaporative fuel carried off from evaporative fuel staying in the purging passage and the intake passage into the combustion chamber, in a manner depending on the delay time calculated by the delay time-calculating means.

The above and other objects, features and advantages of the invention will become more apparent from the following detailed description taken in conjunction with the accompanying drawings.

BRIEF DESCRIPTION OF THE DRAWINGS

FIG. 7 shows a flowchart of a QVAPER-determining routine;

FIG. 8 shows a QBE map;

FIG. 14 shows a $\tau p$ map;

FIG. 15 shows a Ba map;

FIG. 16 shows a Bb map;

FIG. 18 shows a flowchart of a GAIRP-determining routine;

FIG. 20 shows a KPU map;

FIG. 25 shows a flowchart of a LPUCMD-determining routine;

FIG. 27 shows an LPUCMD map;

FIG. 30 shows an A map;

FIG. 31 shows a B map;
FIG. 34 shows a KEA map;
FIG. 35 shows a KEB table.

DETAILED DESCRIPTION

The invention will now be described in detail with reference to the drawings showing embodiments thereof.

Figure 1:
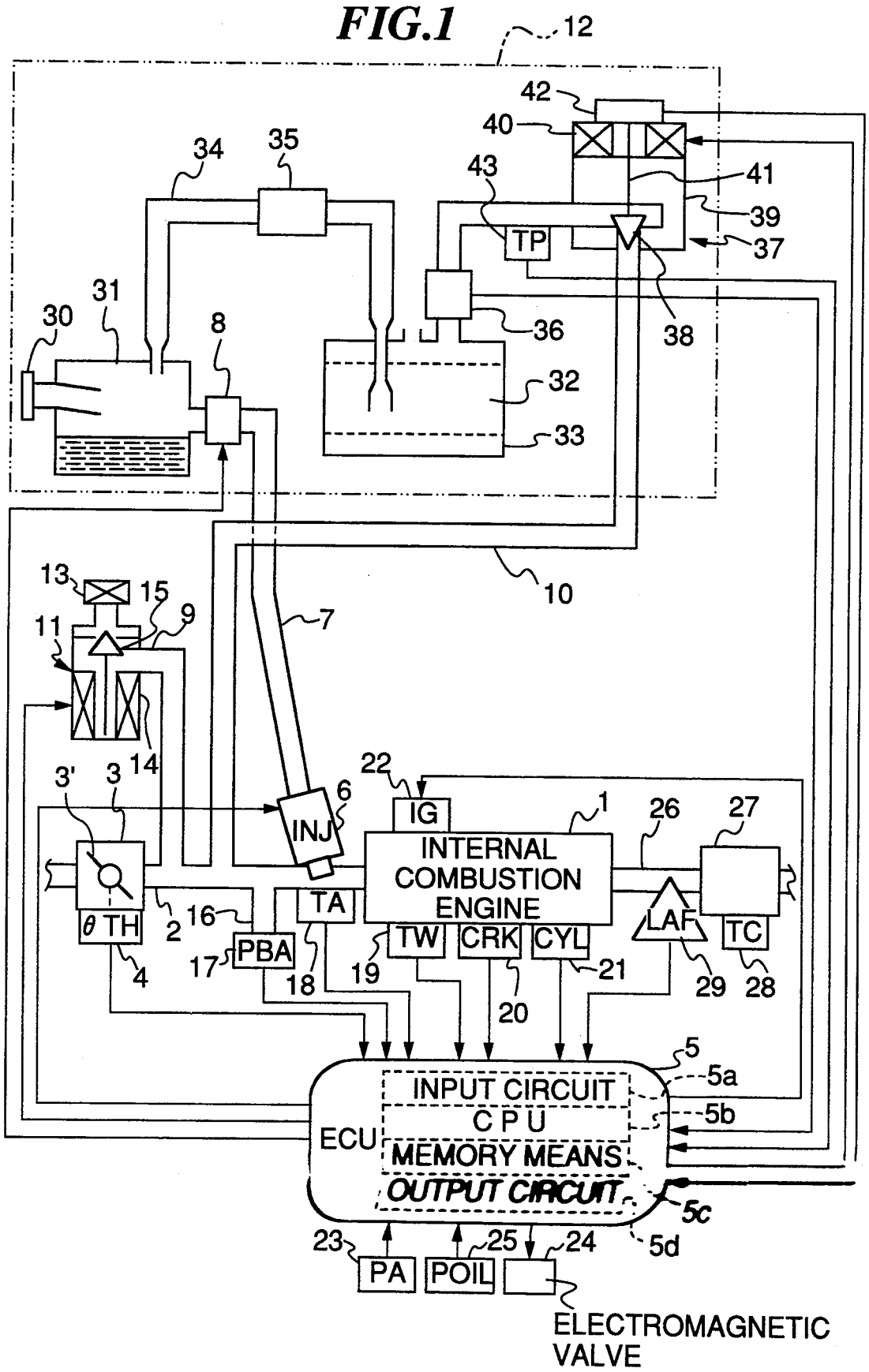
FIG. 1 is a diagram showing a control system for an internal combustion engine, according to an embodiment of the invention.

Referring first to FIG. 1, there is illustrated the whole arrangement of a control system for an internal combustion engine according to an embodiment of the invention.

In the figure, reference numeral 1 designates a DOHC straight type four-cylinder engine (hereinafter simply referred to as "the engine"), each cylinder being provided with a pair of intake valves, not shown, and a pair of exhaust valves, not shown. This engine is constructed such that it is capable of changing the operating characteristics of the intake valves and exhaust valves, for example, the valve opening period and the valve lift (generically referred to hereinafter as "the valve timing") between a high speed valve timing (hereinafter referred to as "the high speed V/T") adapted to a high engine speed region and a low speed valve timing (hereinafter referred to as "the low speed V/T") adapted to a low engine speed region.

Connected to an intake port, not shown, of the cylinder block of the engine 1 is an intake pipe 2 across which is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electric control unit (hereinafter referred to as "the ECU 5").

Fuel injection valves 6, only one of which shown, are inserted into the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 8 and electrically connected to the ECU 5 to have their valve opening periods controlled by signals therefrom.

An auxiliary air-introducing pipe 9 and a purging passage 10 open into the intake pipe 2 at locations downstream of the throttle valve 3' for connecting the intake pipe 2 to an auxiliary air amount control valve (hereinafter referred to as "the AIC valve" 11 and an evaporative emission control system 12 (referred to hereinafter), respectively.

The AIC valve 11 is an electromagnetic valve of a normally-closed type which comprises an air-introducing port having an air cleaner 13 mounted thereon, a solenoid 14, and a valving element 15 adapted to open the valve 11 to allow air to be drawn into the auxiliary air-introducing pipe 9 when the solenoid 14 is energized. The solenoid 14 is electrically connected to the ECU 5 from which a signal indicative of a valve lift command value ICMDM is supplied thereto to control the opening of the AIC valve 11.

Further, an intake pipe absolute pressure (PBA) sensor 17 is provided in communication with the interior of the intake pipe 2 via a conduit 16 opening into the intake pipe 2 at a location downstream of the purging passage 10 for supplying an electric signal indicative of the sensed absolute pressure within the intake pipe 2 to the ECU 5.

An intake air temperature (TA) sensor 18 is inserted into the intake pipe 2 at a location downstream of the conduit 16 for supplying an electric signal indicative of the sensed intake air temperature TA to the ECU 5.

An engine coolant temperature (TW) sensor 19 formed of a thermistor or the like is inserted into a coolant passage filled with a coolant and formed in the cylinder block, for supplying an electric signal indicative of the sensed engine coolant temperature TW to the ECU 5.

A crank angle (CRK) sensor 20 and a cylinder-discriminating (CYL) sensor 21 are arranged in facing relation to a camshaft or a crankshaft of the engine 1, neither of which is shown.

The CRK sensor 20 generates a CRK signal pulse whenever the crankshaft rotates through a predetermined angle (e.g. 30 degrees) smaller than half a rotation (180 degrees) of the crankshaft of the engine 1, while the CYL sensor 21 generates a pulse (hereinafter referred to as "the CYL signal pulse") at a predetermined crank angle of a particular cylinder of the engine, both of the CRK signal pulse and the CYL signal pulse being supplied to the ECU 5.

Each cylinder of the engine has a spark plug 22 electrically connected to the ECU 5 to have its ignition timing controlled by a signal therefrom. Further, an atmospheric pressure (PA) sensor 23 is arranged at a suitable location of the engine 1 for supplying an electric signal indicative of the sensed atmospheric pressure (PA) to the ECU 5.

Further, connected to an output circuit 5*d* of the ECU 5 is an electromagnetic valve 24 for making changeover of the valve timing, which has opening and closing operations thereof controlled by the ECU 5. The electromagnetic valve 24 selects either high or low hydraulic pressure applied to a valve timing changeover device, not shown. Responsive to this high or low hydraulic pressure selected, the valve timing changeover device operates to change the valve timing to either the high speed V/T or the low speed V/T. The hydraulic pressure applied to the valve timing changeover device is detected by a hydraulic pressure (oil pressure) (Poil) sensor 25 which supplies a signal indicative of the sensed hydraulic pressure to the ECU 5.

A catalytic converter (three-way catalyst) 27 is arranged in an exhaust pipe 26 connected to an exhaust port, not shown, of the engine 1 for purifying noxious components, such as HC, CO, NOx, which are present in exhaust gases.

A catalyst temperature (TC) sensor 28, which is formed of a thermistor or the like, is inserted into a wall of the catalytic converter 27 for supplying a signal indicative of the sensed temperature of a catalyst bed of the catalytic converter 27 to the ECU 5.

A linear output type air-fuel ratio sensor (hereinafter referred to as "the LAF sensor") 29 is arranged in the exhaust pipe 26 at a location upstream of the catalytic converter 27. The LAF sensor 29 supplies an electric signal which is substantially proportional to the concentration of oxygen present in the exhaust gases to the ECU 5.

The evaporative emission control system 12 comprises a fuel tank 31 equipped with a filler cap 30 which is opened at the time of refueling, a canister 33 accommodating activated carbon 32 as an adsorbent for adsorbing evaporative fuel generated from the fuel tank 31 for temporary storage therein, an evaporative fuel-guiding passage 34 connecting between the canister 33 and the fuel tank 31, and a two-way valve 35 formed of a positive pressure valve and a negative pressure valve, neither of which is shown, and arranged in the evaporative fuel-guiding passage 34.

The evaporative emission control system 12 further includes a hot wire type flowmeter (hereinafter simply referred to as "the flowmeter") 36, and a purge control valve 37, which are arranged in the purging passage 10 at a location close to the canister 33, and at a location downstream of the flowmeter 36, respectively.

The flowmeter 36 has a platinum wire, not shown, and utilizes the phenomenon that when the platinum wire heated by conduction of electricity is exposed to a stream of a gas, the temperature thereof lowers decrease the electric resistance thereof. It has an output characteristic dependent on the concentration, flow rate, etc. of evaporative fuel, and supplies an electric signal having a level varying with these parameters.

The purge control valve 37 is an electromagnetic valve of a normally-open type which is comprised of a valving element 38 in the form of a wedge which is vertically movable to open and close the purging passage 10, a casing 39 accommodating the valving element 38, a solenoid 40 which electromagnetically drives the valving element 38 via a valve stem 41 in a vertical direction, and a valve lift sensor (hereinafter referred to as "the PRG L sensor") 42 connected to the valve stem 41. The solenoid 40 is electrically connected to the ECU 5 to be supplied with an electric signal therefrom to perform duty-control of the valve lift amount of the valving element 38 based on the electric signal. The PRG L sensor 42 detects the valve lift amount of the valving element 38 and supplies an electric signal indicative of the sensed valve lift amount to the ECU 5.

A purging temperature (TP; temperature of purged gas) sensor 43 is arranged in the purging passage 10 at a location between the flowmeter 36 and the purge control valve 37 for supplying an electric signal indicative of the sensed purging temperature TP to the ECU 5.

The ECU 5 comprises an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* (including a ring buffer, not shown) formed of a ROM storing various operational programs which are executed by the CPU 5*b*, and various maps and tables, referred to hereinafter, and a RAM for storing results of calculations therefrom, etc., the aforementioned output circuit 5*d* which outputs driving signals to the fuel injection valves 6, the spark plugs 22, the fuel pump 8, the electromagnetic valves 24, the solenoids 14, 40, etc. respectively.

Figure 2:
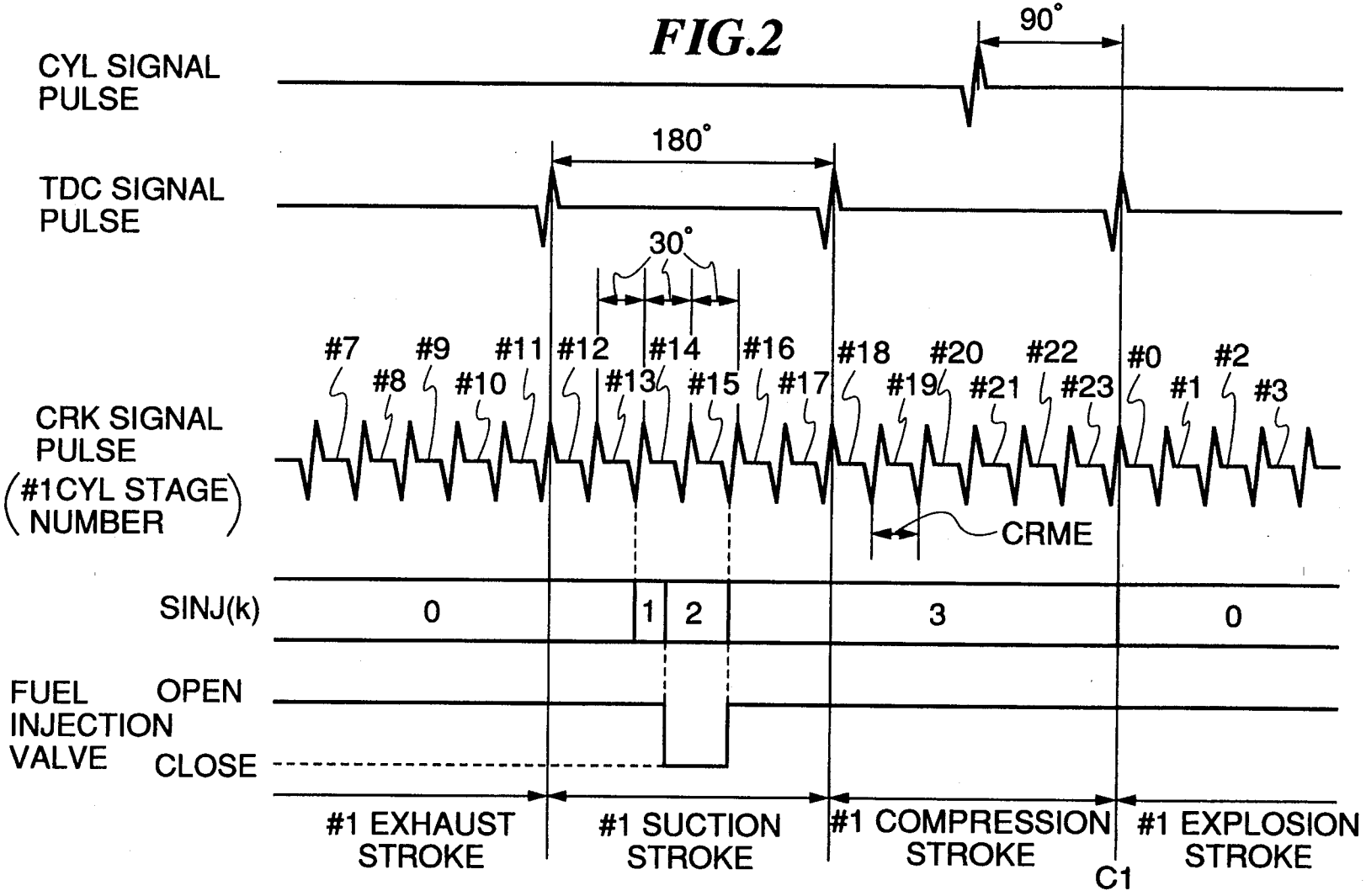
FIG. 2 shows a timing chart showing CYL signal pulses, TDC signal pulses, CRK signal pulses, a status number SINJ(k) and the operative state of the fuel injection valve.

FIG. 2 shows a timing chart showing the relationship in timing between the CRK signal pulses from the CRK sensor 20, the CYL signal pulses from the CYL sensor 21, TDC signal pulses, and injection timing of fuel by the fuel injection valves 6.

Twenty-four CRK signal pulses are generated per two rotations of the crankshaft at regular intervals, i.e. whenever the crankshaft rotates through 30 degrees starting from the top dead center position of any of the four cylinders (#1 to #4 CYL). The ECU 5 generates a TDC signal pulse in synchronism with a CRK signal pulse generated at the top dead center position of each cylinder. The TDC signal pulses generated sequentially indicate reference crank angle positions of the respective cylinders and are each generated whenever the crankshaft rotates through 180 degrees. The ECU 5 measures time intervals of generation of the CRK signal pulses to calculate CRME values, which are added together over each time period elapsed before two TDC signal pulses are generated i.e. over each time period of one rotation of the crankshaft to calculate a ME value, and then calculates the engine rotational speed NE, which is the reciprocal of the ME value.

CYL signal pulses are generated as briefly described above, at a predetermined crank angle position of a particular cylinder (cylinder #1 in the illustrated example), e.g. when the #1 cylinder is in a position 90 degrees before a TDC position thereof corresponding to the end of the compression stroke of the cylinder, to thereby allot a particular cylinder number (e.g. #1 CYL) to a TDC signal pulse generated immediately after the CYL signal pulse is generated.

The ECU 5 detects crank angle stages (hereinafter referred to as "the stages") in relation to the reference crank angle position of each cylinder, based on the TDC signal pulses and the CRK signal pulses. More specifically, the ECU 5 determines, for instance, that the #1 cylinder is in a #0 stage when a CRK signal pulse is generated, which corresponds to a TDC signal pulse generated at the end of compression stroke of the #1 cylinder and immediately following a CYL signal pulse. The ECU sequentially determines thereafter that the #1 cylinder is in a #1 stage, in a #2 stage, . . . and in a #23 stage, based on CRK signal pulses generated thereafter.

Further, an injection stage of a cylinder at which injection should be started is set depending on operating conditions of the engine, more particularly by executing an injection stage-determining routine, not shown. Further, a valve opening period (fuel injection period TOUT) is controlled by the use of a status number (SINJ(k)) determined in relation to the injection stage.

More specifically, the status number SINJ(k) is set to "2" during the valve opening period of a fuel injection valve, and changed to "3" immediately after termination of injection. The status number SINJ(k) is reset to "0" simultaneously when the explosion stroke starts, to set the fuel injection valve 6 into a standby state for injection. Thereafter, when the cylinder reaches the next injection stage (e.g. the #13 stage), the status number SINJ(k) is set to "1", and after an injection delay time period dependent on the fuel injection period TOUT elapses, the status number SINJ(k) is set to "2" again to start fuel injection via the fuel injection valve 6. After termination of fuel injection, the status number SINJ(k) is set to "3", and upon start of the explosion stroke, it is reset to "0" again. In the present embodiment, as will be described hereinafter with reference to FIG. 38, an amount (TWP) of fuel adhering to the inner wall surface of the intake pipe 2 is calculated when SINJ(k)=3, and then the fuel injection period TOUT is calculated, taking the adhering amount TWP of fuel into account. The injection delay time period (corresponding to the time period over which the status number SINJ(k) is equal to "1") is provided for controlling the injection timing such that the termination of fuel injection is synchronous with generation of a CRK signal pulse. By provision of the predetermined injection delay mime period, the start of fuel injection is controlled to a desired timing to thereby control the fuel injection time period as desired.

Next, details of fuel amount control and auxiliary air amount control carried out by the control system according to the present embodiment will be described.

[I] Fuel Amount Control

In this embodiment, an amount of evaporative fuel purged from the canister 33 is accurately calculated, and further, a required amount of fuel to be injected by the fuel injection valve is calculated with the amount of evaporative fuel taken into account. Then, a final fuel injection amount to be supplied to the cylinder is determined with the amount TWP of fuel adhering to the wall surface of the intake pipe 2 taken into account.

Further, in the present embodiment, the ratio of an amount of injected fuel to an amount of purged evaporative fuel supplied to the engine is determined, to thereby determine a valve lift command value LPUCMD supplied to the purge control valve 37.

The fuel amount control will now be described in detail by dividing it into an evaporative fuel-processing procedure and an adhering fuel-dependent correction processing procedure, with reference to FIG. 3 to FIG. 27 and FIG. 28 to FIG. 38, respectively. In these figures and also in those figures of the auxiliary air amount control described hereinbelow, each control routine is expressed according to a program notation defined in JIS X 0128, i.e. by the use of SPD (Structured Programming Diagrams).

[A] Evaporative fuel processing

Figure 3:
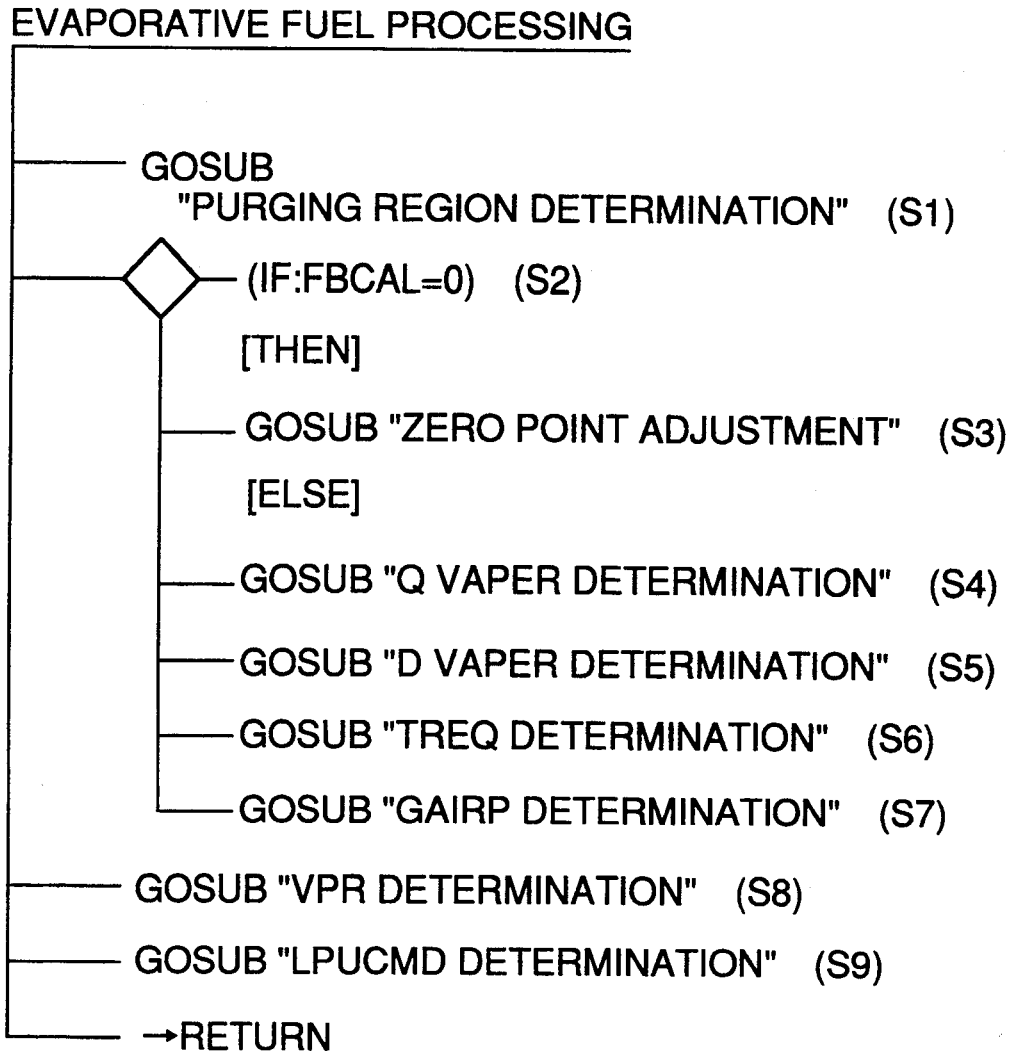
FIG. 3 shows a flowchart of an evaporative fuel processing routine.

FIG. 3 shows a main routine for carrying out evaporative fuel processing control.

First, at a step S1, it is determined whether or not the engine is in a purging region, by executing a purging region-determining subroutine. In the purging-region-determining subroutine, at least when the engine is determined to be in the purging region, the control system is set to a mode for calculating the mass of evaporative fuel purged from the canister 33. In this connection, it is known that evaporative fuel purged from the canister 33 is composed nearly solely of butane. Therefore, in the present embodiment, the control operations are executed on the assumption that evaporative fuel consists of 100% butane. That is, at least when the engine is determined to be in the purging region, a flag FBCAL is set to "1" to set the control system to a butane mass-calculating mode for calculating the mass of butane as the mode for calculating the mass of evaporative fuel.

Next, at a step S2, it is determined whether or not the flag FBCAL is equal to "0". If FBCAL=0, which means that the control system is set to a mode other than the butane mass-calculating mode, the program proceeds to a step S3, where a zero point-adjusting routine is executed to effect zero point adjustments of the flowmeter 36 and the operating position of the valving element 38 of the purge control valve 37, followed by the program proceeding to a step S8.

On the other hand, if it is determined at the step S2 that FBCAL is equal to "1", which means that the control system has been set to the butane mass-calculating mode, a QVAPER-determining routine, a DVAPER-determining routine, a TREQ-determining routine, and a GAIRP-determining routine are executed at steps S4 to S7, respectively, followed by the program proceeding to the step S8. More specifically, in the QVAPER-determining routine, a volume QVHD of purged gas (air+butane) purged over a predetermined time period and the concentration CBU of butane present in the purged gas are calculated. In the DVAPER-determining routine, the mass PGIN of butane drawn into the cylinder during the suction stroke of the present cycle is calculated, based on dynamic characteristics of the purged gas, described hereinafter. Further, in the TREQ-determining routine, a required fuel injection period TREQ over which the fuel injection valve 6 should be opened during the suction stroke of the present cycle is calculated. In the GAIRP-determining routine, an amount GAIRP of air contained in the purged gas drawn into the combustion chamber during suction stroke of the present cycle is calculated, followed by the program proceeding to the step S8

Then, at the step S8, a VPR-determining routine is executed to calculate an injection fuel decremental coefficient KPUN dependent on the amount of evaporative fuel, in dependence on operating conditions of the engine, and at the same time a desired output voltage VHCMD of the flowmeter 36 is calculated. Finally, at a step S9, an LPUCMD-determining routine is executed to determine the valve lift command value LPUCMD for the valving element 38 of the purge control valve 37, followed by terminating the program.

The subroutines of the steps S1 to S9 will now be described in detail in the order of the step numbers.

(1) Purging region determination (at the step S1 of the FIG. 3)

Figure 4:
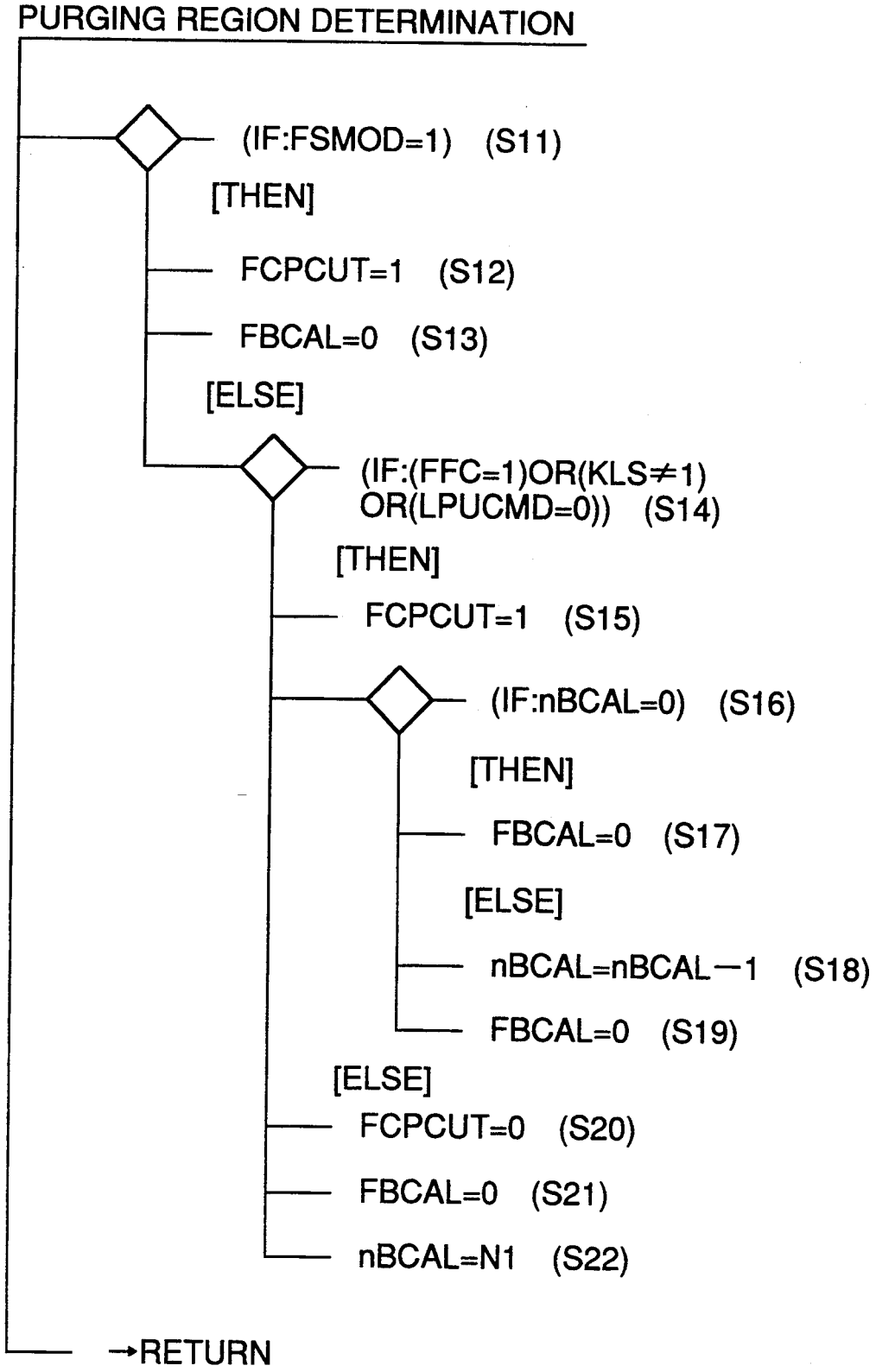
FIG. 4 shows a flowchart of a purging region-determining routine.

FIG. 4 shows a purging region-determining routine, which is executed in synchronism with generation of each TDC signal pulse.

First, at a step S11, it is determined whether or not a flag FSMOD is equal to "1", i.e. whether the engine is in a starting mode. The determination as to whether the engine is in the starting mode or not is effected by determining whether a starter switch, not shown, of the engine has been turned on, and at the same time the engine rotational speed NE is equal to or lower than a predetermined starting speed (cranking speed).

If the flag FSMOD is equal to "1", it is judged that the engine is in the starting mode, and then a flag FCPCUT is set to "1" at a step S12. More specifically, the solenoid 40 is energized to close the purge control valve 37 to thereby inhibit purging of evaporative fuel. Then, the flag FBCAL is set to "0" at a step S13 to inhibit the butane weight calculation, followed by terminating the routine and returning to the FIG. 3 main routine.

On the other hand, if the flag FSMOD is equal to "0", i.e. if the engine is in a basic operating mode, the program proceeds to a step S14, where it is determined whether a flag FFC is equal to "0", which means that the engine is under fuel cut, or whether a leaning correction coefficient KLS is equal to a predetermined value other than "1", or whether the valve lift command value LPUCMD for the purge control valve 37 is equal to "0". Whether the engine is under fuel cut is determined based on the engine rotational speed NE and the valve opening θTH of the throttle valve 3', more specifically, by executing a fuel cut-determining routine, not shown. The leaning correction coefficient KLS is set to "1" when the engine is not in a leaning region in which the air-fuel ratio of a mixture supplied to the engine should be controlled to a lean value, whereas when the engine is in the leaning region, it is set to a predetermined value smaller than "1", which is dependent on the leaning region. Further, the valve lift command value LPUCMD is determined by executing the LPUCMD-determining routine (see FIG. 25) mentioned at the step S8 of the FIG. 3 main routine. If none of the three conditions is satisfied, i.e. if FFC is equal to 0, KLS is equal to 1, and LPUCMD is not equal to 0, the program proceeds to a step S20, where a flag FCPCUT is set to "0", whereby the solenoid 40 is deenergized to open the purge control valve 37 to allow evaporative fuel to be purged into the intake pipe 2, and then the program proceeds to a step S21. At the step S21, the flag FBCAL is set to "1" to set the control system to the butane mass-calculating mode, and then a count value nBCAL of a delay counter (first delay counter), not shown, for butane mass calculation is set to a predetermined value N1 (e.g. 16) at a step S22, followed by terminating the routine. The first delay counter is provided for compensation for a time period required to elapse before the flow rate of the purged gas is actually reduced to zero after the satisfaction of the purge-cut conditions (FCPCUT=1) in the basic operating mode of the engine. That is, it is provided to cope with a time lag in the purge control. If any of the three conditions of the step S14 is satisfied in a subsequent loop, the program proceeds to a step S15, where the flag FCPCUT is set to "1" to inhibit purging of evaporative fuel. Then, at a step S16, it is determined whether or not the count value nBCAL of the first delay counter is equal to "0". If the count value nBCAL is not equal to "0", the program proceeds to a step S18, where the count value nBCAL is decreased by a decremental value of 1, and the flag FBCAL is set to "1" at a step S19, followed by terminating the routine. If the count value nBCAL becomes equal to "0" in a subsequent loop, the flag FBCAL is set to "0" at a step S17 to inhibit calculation of the mass of purged butane (evaporative fuel), followed by terminating the routine and returning to the FIG. 3 main routine.

Thus, even if the purge-cut conditions are satisfied to set the flag FCPCUT to "1", the butane mass calculation continues to be carried out over a predetermined time period, to cope with the time lag in the purge control, which makes it possible to achieve enhanced controllability.

(2) Zero point adjustment (at the step S3 of FIG. 3)

Figure 5:
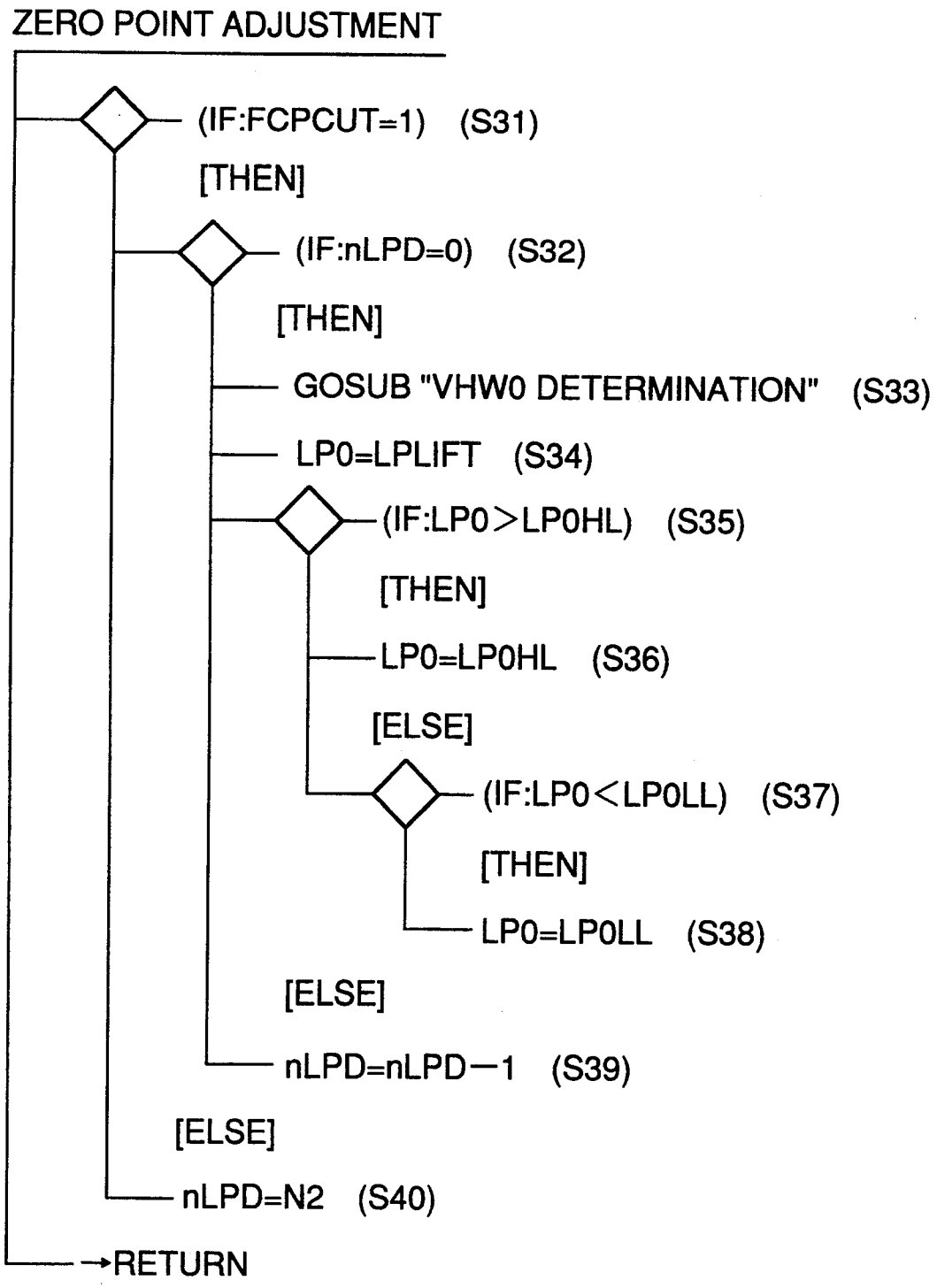
FIG. 5 shows a flowchart of a zero point-adjusting routine.

FIG. 5 shows a zero point-adjusting routine, which is executed in synchronism with generation of false signal pulses e.g. at time intervals of 10 msec from a timer, not shown, incorporated in the ECU 5.

First, at a step S31, it is determined whether or not the flag FCPCUT is equal to "1", i.e. whether or not purging of evaporative fuel is inhibited. If the flag FCPCUT is not equal to "1", i.e. if the evaporative fuel is being purged, the program proceeds to a step S40, where a count value nLPD of a delay counter (second delay counter), not shown, for calculation of a zero point learned value is set to a predetermined value N2 (e.g. 4), followed by terminating the routine. On the other hand, if it is determined at the step S31 that the flag FCPCUT is equal to "1", which means that the evaporative fuel is being purged, the program proceeds to a step S32, where it is determined whether or not the count value nLPD of the second delay counter is equal to "0". In the first loop to pass this step, the count value nLPD is hoe equal to "0", so that the program proceeds to a step S39, where the count value nLPD is decreased by a decremental value of 1, followed by terminating the routine. On the other hand, if the count value nLPD becomes equal to "0" in a subsequent loop, the program proceeds to a step S33, where a VHW0-calculating routine is executed to perform the zero point adjustment of the flowmeter 36.

Figure 6:
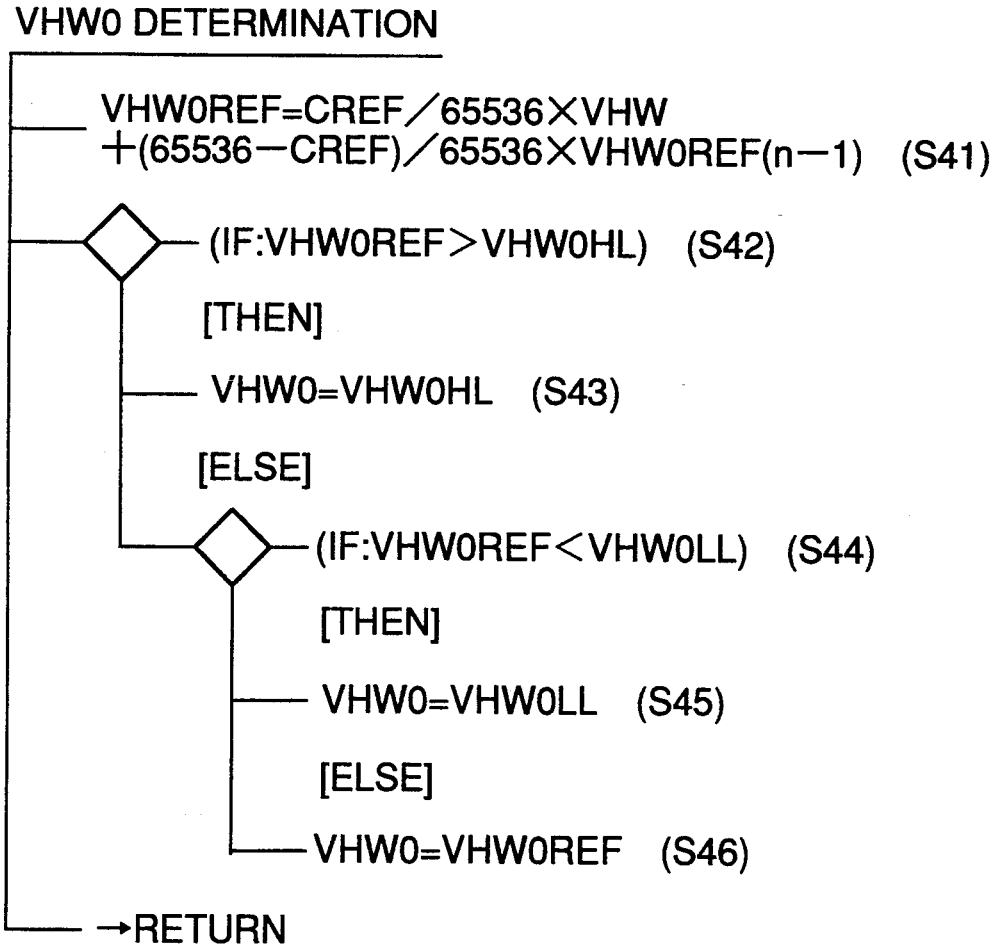
FIG. 6 shows a flowchart of a VHW0-determining routine.

More specifically, as shown in FIG. 6, the zero point learned value VHW0REF is calculated at a step S41 by the use of Equation (1):

$$VHW0REF=(CREF/65536)\times VHW+[(65536-CREF)/65536]\times VHW0REF(n-1) \quad (1)$$

where CREF represents a variable suitably selected from a range of 1 to 65536 depending on the internal temperature of the flowmeter 36, and VHW0REF(n−1) represents the immediately preceding value of the zero point learned value VHW0REF. By learning a value of the output voltage VHW from the flowmeter 36 on the basis of the immediately preceding value VHW0REF(n−1) when the purging of the evaporative fuel is inhibited, the zero point learned value VHW0REF is updated. Therefore, the zero point learned value VHW0REF represents an average value of the output voltage VHW assumed when the purge cut is performed, which varies with aging of the flowmeter 36.

Then, at steps S42 to S46, the limit check of the zero point learned value VHW0REF is performed, followed by terminating the routine. More specifically, at a step S42, it is determined whether or not the zero point learned value VHW0REF is higher than a predetermined upper limit value VHW0HL. If VHW0REF>VHW0HL, the zero point VHW0 of the flowmeter 36 is set to the predetermined upper limit value VHW0HL at a step S43, whereas if VHW0REF≦VHW0HL, the program proceeds to a step S44, where it is determined whether or not the zero point learned value VHW0REF is lower than a predetermined lower limit value VHW0LL. If VHW0REF<VHW0LL, the zero point VHW0 is set to the predetermined lower limit value VHW0LL at a step S45, whereas if VHW0REF≧VHW0LL, the zero point VHW0 is set to the zero point learned value VHW0REF calculated by the use of Equation (1), followed by terminating the zero point adjustment and returning to the FIG. 5 zero point-adjusting routine.

Then, the program proceeds to a step S34 of the FIG. 5 routine, an actual value of the valve lift amount (i.e. detected valve lift value) LPLIFT of the PRG L sensor 42 is set to a zero point LP0 thereof. Then, at step S35 to S38, a limit check of the zero point LP0 is performed, followed by terminating the zero point adjustment. More specifically, at a step S35, it is determined whether or not the zero point LP0 is larger than a predetermined upper limit value LP0HL. If LP0>LP0HL, the zero point LP0 is set to the predetermined upper limit value LP0HL at a step S36, whereas if LP0<LP0HL, the program proceeds to a step S37, where it is determined whether or not the zero point LP0 is smaller than a predetermined lower limit value LP0LL. If LP0<LP0LL, the zero point LP0 is set to the predetermined lower limit value LP0LL at a step S38, followed by terminating the zero point adjustment of the PRG L sensor 42 and returning to the FIG. 3 main routine.

(3) QVAPER determination (determination of the concentration CBU of butane and the volume QHWD of purged gas) (at the step S4 of FIG. 3)

FIG. 7 shows a QVAPER-determining routine, which is executed in synchronism with generation of each TDC signal pulse.

First, at a step S51, the ECU 5 stores into the memory means 5c information on engine operating parameters, such as the engine rotational speed NE, the intake pipe absolute pressure PBA, the atmospheric pressure PA, the purging temperature TP, the detected valve lift value LPLIFT of the )PRG L sensor 42, and the output voltage VHW from the flowmeter 36.

Then, at a step S52, a net or actual valve Lift value LPACT (=LPLIFT−LP0) of the PRG L sensor 42 is calculated, and then at a step S53, a net or actual output voltage VHACT (=VHW−VHW0) from the flowmeter 36 is calculated.

Then, at a step S54, a QBE map is retrieved to determine a first basic flow rate value QBEM.

The QBE map is set, e.g. as shown in FIG. 8, such that map values QBEM (00, 00) to QBEM (15, 15) are provided in a manner corresponding to predetermined values PBG00 to PBG15 of negative pressure (gauge pressure) within the intake pipe 2 as a difference between the atmospheric pressure PA and the intake pipe absolute pressure PBA, and predetermined values LPACT00 to LPACT15 of the net valve lift value LPACT of the PRG L sensor 42. The first basic flow rate value QBEM is calculated based on the intake pipe negative pressure PBG and the net valve lift value LPACT by the use of Equation (2) based on known Bernoulli's equation, and the map values QBEM are determined based on the predetermined values of the intake pipe negative pressure PBG and the net valve lift valve LPACT:

$$QBEM = A\sqrt{(2PBG/\rho)} \quad (2)$$

where A represents an area of opening of the purge control valve 37, which is determined as a function of the net valve lift valve LPACT, and $\rho$ a fluid density. The first basic flow rate value QBEM is determined by retrieving the QBEM map, and additionally by interpolation, if required.

Then, at a step S55, a QHW table is retrieved to determine a second basic flow rate value QHW.

Figure 9:
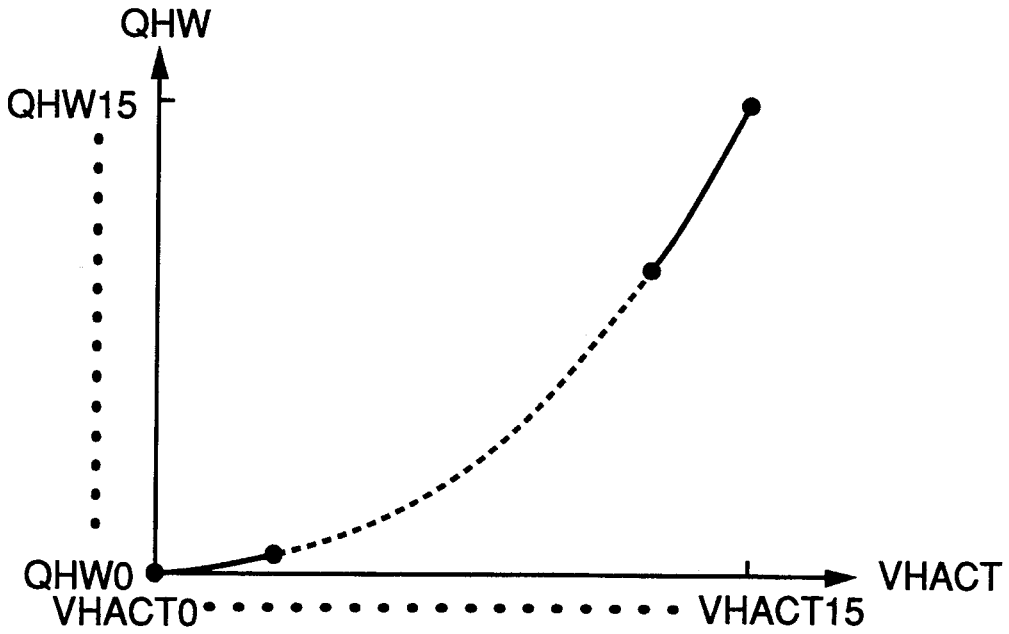
FIG. 9 shows a QHW table.

The QHW table is set, e.g. as shown in FIG. 9, such that table values QHW0 to QHW15 are provided in a manner corresponding to predetermined values VHACT0 to VHACT15 of the net output voltage from the flowmeter 36. The second basic flow rate value QHW is calculated based on the net output voltage VHACT from the flowmeter 36 by the use of Equation (3) based on known King's equation. The table values QHW are thus determined based on the net output voltage VHACT:

$$QHW=A'\times\{[(VHACT)^2-R\times C]/(R\times B)\}^2 \quad (3)$$

where A' represents the inner diameter of the purging passage 10, R the electric resistance of the platinum wire of the flowmeter 36, B and C constants dependent on the temperature and properties of the fluid (purged gas), the size of the platinum wire, etc. The second basic flow rate value QHW is determined by retrieving the QHW table, and additionally by interpolation, if required.

Then, the program proceeds to a step S56, where a KTP table is retrieved to determine a purging temperature-dependent correction coefficient KTP for the first basic flow rate value QBEM.

Figure 10:
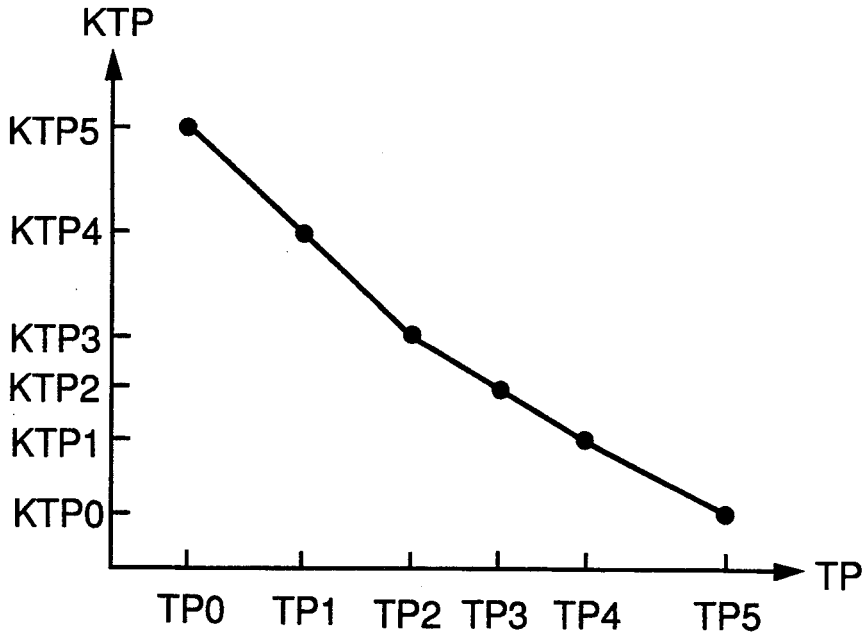
FIG. 10 shows a KTP table.

The KTP table is set, e.g. as shown in FIG. 10, such that table values KTP0 to KTP5 are provided in a manner corresponding to predetermined values TP0 to TP5 of the purging temperature TP. The purging temperature-dependent correction coefficient KTP is determined by retrieving the KTP table, and additionally by interpolation, if required.

Then, the program proceeds to a step S57, where a KPAP table is retrieved to determine an atmospheric pressure-dependent correction coefficient KPAP for the first basic flow rate value QBEM.

Figure 11:
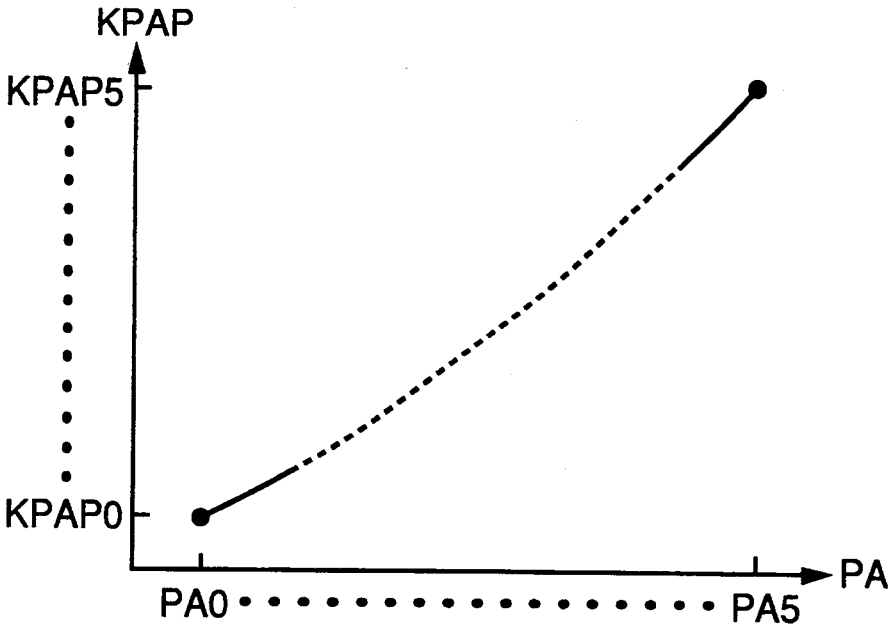
FIG. 11 shows a KPAP table.

The KPAP table is set, e.g. as shown in FIG. 11, such that table values KPAP0 to KPAP5 are provided in a manner corresponding to predetermined values PA0 to PA5 of the purging temperature TP. The atmospheric pressure-dependent correction coefficient KPAP is determined by retrieving the KPAP table, and additionally by interpolation, if required.

Then, the program proceeds to a step S58, where a first flow rate value QBE is calculated by the use of Equation (4), and then at a step S59, the ratio of a second flow rate value QHW (which is equal to the second basic flow rate value) to the first flow rate value QBE, i.e. the flow rate ratio KQ, is calculated:

$$QBE=QBEM\times KTP\times KPAP \quad (4)$$

$$KQ=QHEW/QBE \quad (5)$$

Then, at a step S60, a CBU table is retrieved to determine the concentration CBU of butane present in the purged gas.

Figure 12:
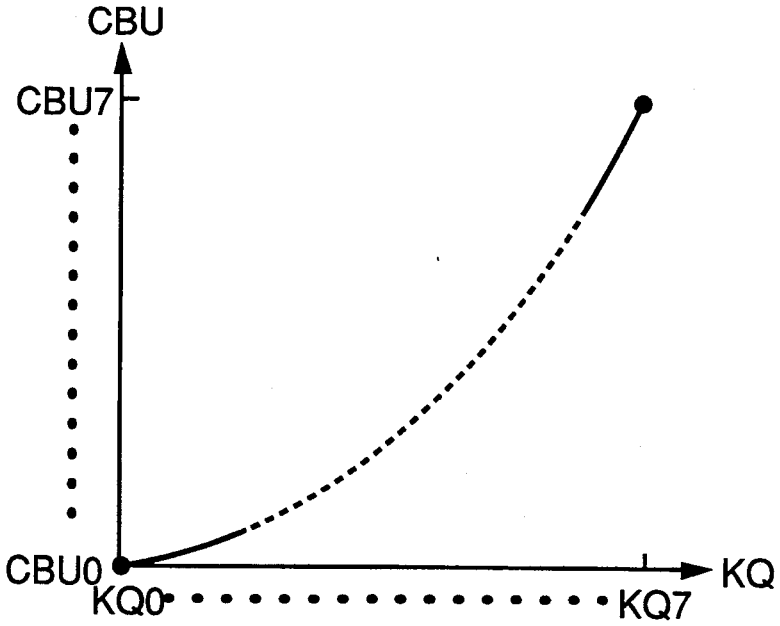
FIG. 12 shows a CBU table.

The CBU table is set, e.g. as shown in FIG. 12, such that table values CBU0 to DBU7 are provided in a manner corresponding to predetermined values KQ0 to KQ7 of the flow rate ratio KQ. The butane concentration CBU is determined by retrieving the CBU table, and additionally by interpolation, if required. As described above, the first flow rate value QBE is calculated by the use of Equation (2) based on Bernoulli's equation, while the second flow rate value QHW is calculated by the use of Equation (3) based on King's equation. The second flow rate value QHW is based on the net output voltage VHACT from the flowmeter 36, which varies with the butane concentration CBU of the purged gas. Accordingly, the first flow rate value QBE and the second flow rate value QHW assume values varying along different curves with the butane concentration CBU. Therefore, the relationship between the flow rate value ratio KQ and the butane concentration CBU is stored in the form of the CBU table into the memory means in advance, and the CBU table is retrieved to determine the butane concentration CBU.

Then, the volume QHWD of purged gas is calculated by the use of Equation (6) over a time period between two adjacent TDC signal pulses (since the engine is a four-cylinder four-cycle type, fuel injection is performed upon generation of each TDC signal pulse), followed by terminating the routine:

$$QHWD=QHW\times ME \quad (6)$$

Thus, the volume QHWD of the purged gas passing through the purge control valve 37 per the time period determined by generation of two adjacent TDC signal pulses is accurately calculated.

(4) DVAPER determination (determination of the mass of butane) (at the step S5 of FIG. 3)

Figure 13:
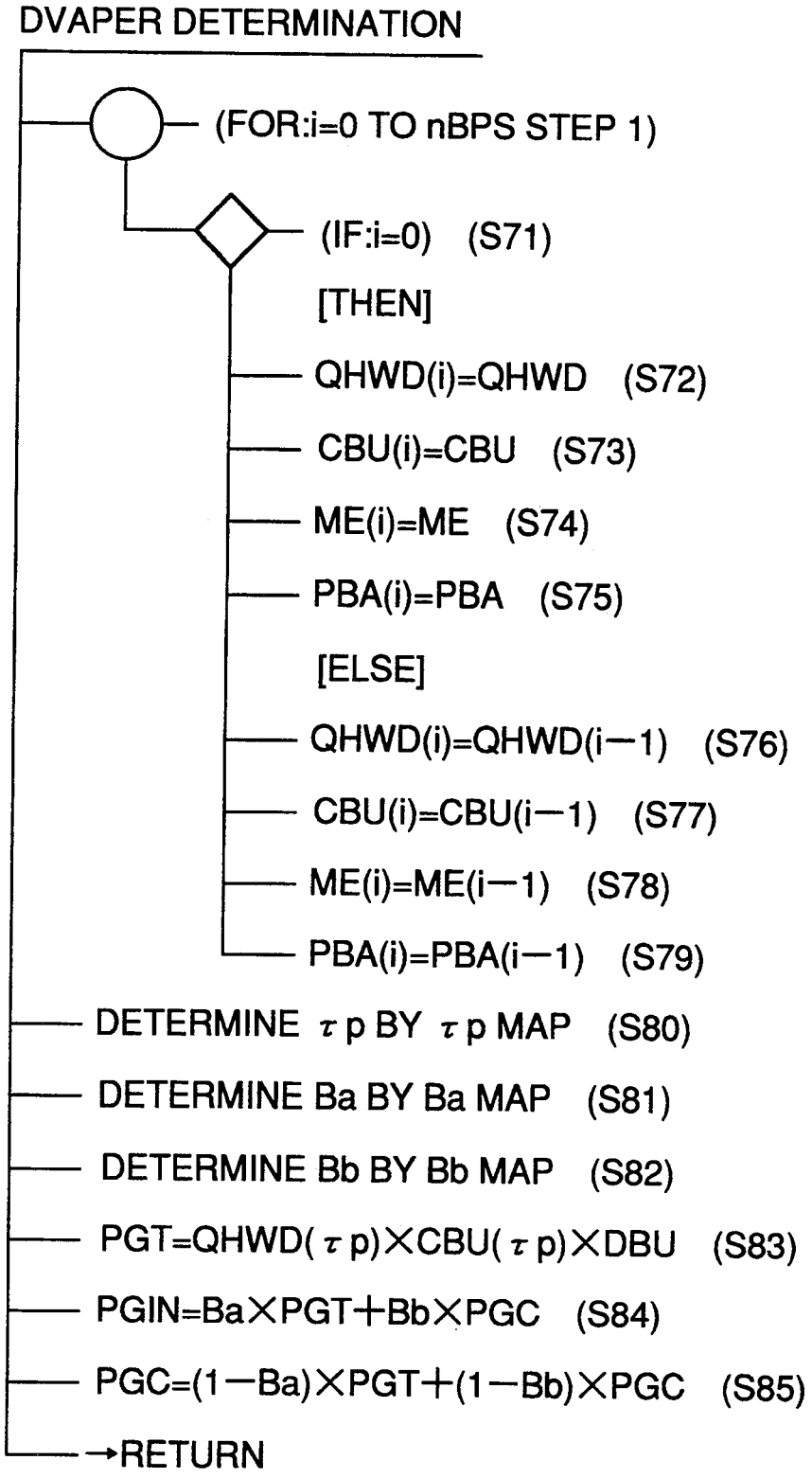
FIG. 13 shows a flowchart of a DVAPER-determining routine.

FIG. 13 shows a DVAPER-determining routine for calculating the mass of butane, by taking the dynamic characteristics of purged gas into consideration, which is executed in synchronism with generation of each TDC signal pulse.

First, at steps S71 to S79, the volume QHWD(i) of purged gas, the butane concentration CBU(i), the ME(i) value, and the intake pipe absolute pressure PBA(i) are sequentially calculated for each cylinder, and stored into the ring buffer. More specifically, the ring buffer BPS is comprised of sections each having a number i (i=0 to n (e.g. n=15)) allotted thereto. The volume QHWD(i) of purged gas, the butane concentration CBU(i), the ME(i) value, and the intake pipe absolute pressure PBA(i) are calculated per each number i of the ring buffer BPS. More specifically, it is determined at a step S71 whether or not the number i of the present section of the ring buffer BPS is equal to "0" or not. If i=0, as shown in the steps S72 to S75, the present values of the volume QHWD of the purged gas, the butane concentration CBU, the ME value, and the intake pipe absolute pressure PBA are stored into the buffer section of i=0. If the number i of the present buffer section is not equal to 0, as shown in steps S76 to S79, the volume QHWD(i−1) of purged gas, the butane concentration CBU(i−1), the ME(i−1) value and the intake pipe absolute pressure PBA(i−1) stored in the buffer section having the immediately preceding number i−1 are stored into the buffer section having the number i (i=1 to n).

Then, a delay time period $\tau p$ before the purged butane reaches the combustion chamber of the engine 1 after it leaves the canister 33 is calculated If the delay time period $\tau p$ is given as a function of the amount of intake air passing through the purging passage 10. More specifically, the $\tau p$ map is set, e.g. as shown in FIG. 14, such that map values $\tau p(0,0)$ to $\tau p(7,7)$ are provided in a manner corresponding to predetermined values PBA0 to PBA7 of the intake pipe absolute pressure PBA and predetermined values ME0 to ME7 of the reciprocal of the engine rotational speed NE. The delay time period $\tau p$ is determined by retrieving the $\tau p$ map, and additionally by interpolation, if required.

Then, at a step S81, a butane direct supply ratio Ba corresponding to the delay time period $\tau p$ is determined by retrieving a Ba map.

The Ba map is set, e.g. as shown in FIG. 15, such that map values Ba(0,0) to Ba(7,7) are provided in a manner corresponding to predetermined values PBA0 to PBA7 of the intake pipe absolute pressure PBA and predetermined values ME0 to ME7 of the reciprocal of the engine rotational speed NE. The butane direct supply ratio Ba means the ratio of an amount of butane as evaporative fuel directly drawn into the combustion chamber of the engine to an amount of butane drawn into the intake pipe 2 from the canister 33 during the present cycle. The butane direct supply ratio Ba is determined by retrieving the Ba map, and additionally by interpolation, if required.

Then, at a step S82, a butane carry-off ratio Bb corresponding to the delay time period $\tau p$ is determined by retrieving a Bb map.

The Bb map is set, e.g. as shown in FIG. 16, such that map values Bb(0,0) to Bb(7,7) are provided in a manner corresponding to predetermined values PBA0 to PBA7 of the intake pipe absolute pressure PBA and predetermined values ME0 to ME7 of the reciprocal the engine rotational speed NE. The butane carry-off ratio Bb means the ratio of an amount of butane as evaporative fuel drawn into the combustion chamber of the engine during the present cycle to an amount of butane having stayed in the intake pipe, etc. up to the immediately preceding cycle. The butane carry-off ratio Bb is determined by retrieving the Bb map, and additionally by interpolation, if required.

Then, at a step S83, a mass PGT of butane in the purged gas flowing through the purge control valve 37 when the delay time period $\tau p$ assumes the calculated value is calculated by the use of Equation (7):

$$PGT=QHWD(\tau p)\times CBU(\tau p)\times DBU \quad (7)$$

where DBU represents a butane density (=2.7 kg/cm$^3$) under the standard state (0° C., 1 atm.). The volume QHWD of purged gas is multiplied by the butane concentration CBU and the butane density DBU, to thereby calculate the total mass PGT of butane present in the purged gas.

At a step S84, a mass PGIN of butane drawn into the combustion chamber of the engine 1 (drawn-in butane) is calculated by the use of Equation (8):

$$PGIN=Ba\times PGT+Bb\times PGC \quad (8)$$

where PGC represents the mass of butane staying within the path of purged gas such as the intake pipe 2, and is initially set to "0". The first term Ba×PGT on the right side represents the mass of butane directly drawn into the combustion chamber, out of butane purged during the present cycle, and the second term Bb×PGC on the right side represents the mass of butane drawn into the combustion chamber during the present cycle, out of butane having stayed within the intake pipe etc. up to the immediately preceding cycle. The mass PGIN of butane drawn into the combustion chamber is obtained by adding together both the masses of butane supplied to the combustion chamber in different manners.

Then, the mass PGC of staying butane is calculated by the use of Equation (9), followed by terminating the routine and returning to the FIG. 3 main routine:

$$PGC=(1-Ba)\times PGT+(1-Bb)\times PGC \quad (9)$$

where the first term (1−Ba)×PGT on the right side represents the mass of butane staying within the intake pipe 2 etc., out of butane purged during the present cycle, and the second term (1−Bb)×PGC on the right side represents the mass of butane staying within the intake pipe 2 etc. even after the present cycle, out of butane having stayed within the intake pipe 2 etc. up to the immediately preceding cycle. The mass PGC of staying butane is obtained by adding together both the masses.

(5) Determination of a required time period TREQ for opening the fuel injection valve (required fuel injection time period) (at the step S6 of FIG. 5)

Figure 17:
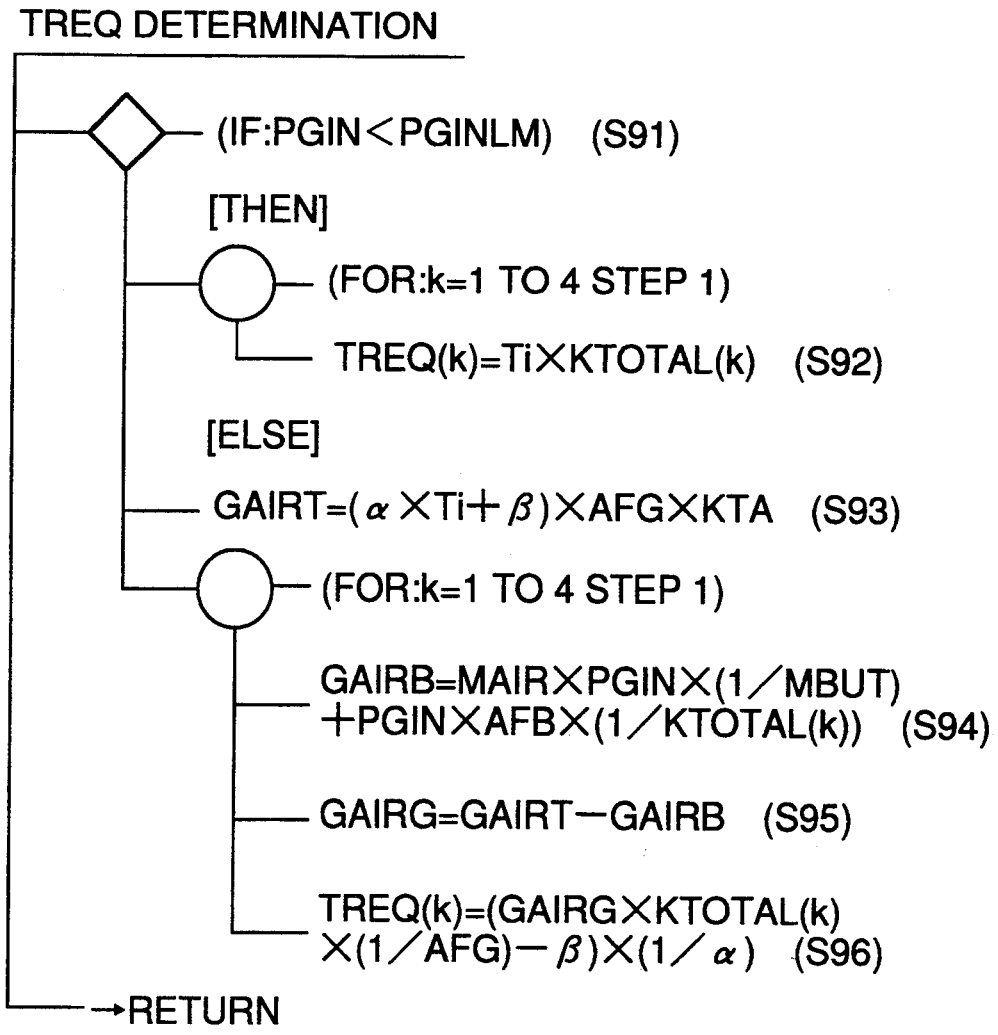
FIG. 17 shows a flowchart of a TREQ-determining routine.

FIG. 17 shows a TREQ-determining routine, which is executed in synchronism with generation of each TDC signal pulse.

First, at a step S91, it is determined whether or not the mass PGIN of drawn-in butane is smaller than a predetermined lower limit value PGINLM. If PGIN<PGINLM, it is judged that the mass PGIN of drawn-in butane is negligible or zero, and the required fuel injection time period (i.e. the required amount of gasoline to be drawn into the combustion chamber) TREQ(k) is sequentially calculated at a step S92 for each cylinder (#1 CYL to #4 CYL) by the use of Equation (10):

$$TREQ(k)=Ti\times KTOTAL(k) \quad (10)$$

where Ti represents a basic fuel injection period calculated when the engine is in the basic operating mode, which is obtained by multiplying a TiM value determined according to the engine rotational speed NE and the intake pipe absolute pressure PBA by an exhaust gas recirculation (EGR)-dependent correction coefficient KEGR. The EGR-dependent correction coefficient KEGR corrects the fuel injection period (or amount) when an exhaust gas recirculation control valve (EGR valve) arranged in an exhaust gas recirculation system, not shown, is in operation, and is set to a predetermined value dependent on the valve opening of the EGR valve. In determining the TiM value, there is used a TiM map, which is comprised of two maps for the low speed V/T and the high speed V/T, both stored in the memory means 5c (ROM).

Further, KTOTAL(k) represents the product of various correction coefficients (intake air temperature-dependent correction coefficient KTA, after-start correction coefficient KAST, desired air-fuel ratio coefficient KCMD, etc.) determined depending on operating conditions of the engine, and is obtained for each cylinder.

On the other hand, if PGIN≧PGINLM, i.e. if the mass of butane drawn into the combustion chamber is not negligibly small, the program proceeds to a step S93, where the total mass GAIRT of air drawn into the combustion chamber during the present cycle is calculated by the use of Equation (11):

$$GAIRT=(\alpha\times Ti+\beta)\times AFG\times KTA \quad (11)$$

where Ti (=TiM×KEGR) represents the basic fuel injection period under the standard state, described above, $\alpha$ and $\beta$ constants, AFG a stoichiometric air-fuel ratio of gasoline (which is approximately equal to 14.6) and KTA the intake air temperature-dependent correction coefficient. In calculating the total mass GAIRT of air by Equation (11), it is assumed that a fuel injection amount Y to be injected is linearly approximate to the basic fuel injection period Ti so that the latter can stand for the former. That is, in the above equation, it is assumed that the fuel injection amount Y can be expressed as $(\alpha\times Ti+\beta)$.

Then, at steps S94 et seq., the mass (hereinafter referred to as "the air mass for butane") GAIRB of air to be consumed for combustion of butane, the mass (hereinafter referred to as "the air mass for gasoline") GAIRG of air to be consumed for combustion of gasoline, and the required fuel injection time period TREQ(k) are calculated for each cylinder.

More specifically, at a step S94, the air mass for butane GAIRB is calculated by the use of Equation (12):

$$GAIRB=(MAIR\times PGIN)/MBUT+(PGIN\times AFB)/KTOTAL(k) \quad (12)$$

where MAIR represents the molecular weight (=28.8) of air, MBUT a molecular weight of butane (=57), AFB a stoichiometric air-fuel ratio (which is approximately equal to 15.5) of butane, and (1/KTOTAL(k)) the excess air ratio λ.

The first term (MAIR×PGIN)/MBUT on the right side represents the mass of air accompanying the mass PGIN of drawn-in butane, and the second term (PGIN×AFB)/KTOTAL(k)) on the right side represents the mass of air necessary for combustion of butane. The air mass for butane GAIRB to be consumed by combustion of butane is calculated by adding together these masses.

Further, at a step S95, the air mass GAIRB for butane is subtracted from the total air mass GAIRT to calculate the air mass for gasoline GAIRG by the use of Equation (13):

$$GAIRG=GAIRT-GAIRB \quad (13)$$

Then, finally at a step S96, the required fuel injection time period TREQ(k) is calculated, followed by terminating the routine and returning to the FIG. 3 main routine.

The required fuel injection time period TREQ(k) is considered to be substantially proportional to the required amount YREQ(k) of gasoline to be injected by the fuel injection valve 6, and hence the required amount GAIRG of air for combustion of gasoline is calculated, similarly to the step S93, by the use of Equation (14):

$$GAIRG=[(\alpha\times TREQ(k)+\beta)\times AFG]/KTOTAL(k) \quad (14)$$

From the Equation (14), Equation (15) is obtained, by the use of which the required fuel injection time period TREQ(k) can be calculated:

$$TREG(k)=[(GAIRG\times KTOTAL(k))/AFG-\beta]/\alpha \quad (15)$$

Thus, the required amount of fuel to be supplied to the combustion chamber by injection during the present cycle is obtained as a function of the fuel injection time period.

(6) GAIRP determination (determination of an amount GAIRP of air contained in purged gas) (at the step S7 of FIG. 3)

FIG. 18 shows a GAIRP-determining routine, which is executed in synchronism with generation of each TDC signal pulse.

First, at a step S101, the volume QHWD($\tau$p) of the purged gas and the butane concentration CBU($\tau$p) corresponding to the delay time period $\tau$p, in which the dynamic characteristic of purged gas is taken into account, are read. Then, at a step S102, concentration CA($\tau$p) of air at this time is calculated based on the butane concentration CBU($\tau$p), and then at a step S103, the amount GAIRP of air contained in the purged gas is calculated by the use of Equation (15), followed by returning to the FIG. 3 main routine.

$$GAIRP=QHWD(\tau p)\times CA(\tau p)\times KTP \quad (15)$$

where KTP represents the purging temperature-dependent correction coefficient determined at the step S56 of the FIG. 7 QVAPER-determining routine.

The amount GAIRP of air contained in the purged gas is used in an ICMDM-determining routine, which will be described in detail hereinafter with reference to FIG. 39, whereby the amount of auxiliary air supplied to the engine is controlled to a value dependent on the amount GAIRP of air contained in purged gas.

(7) VPR determination (determination of the injected fuel decremental coefficient KPUN and the desired output voltage VHCMD from the flowmeter 36) (at the step S8 of FIG. 3)

Figure 19:
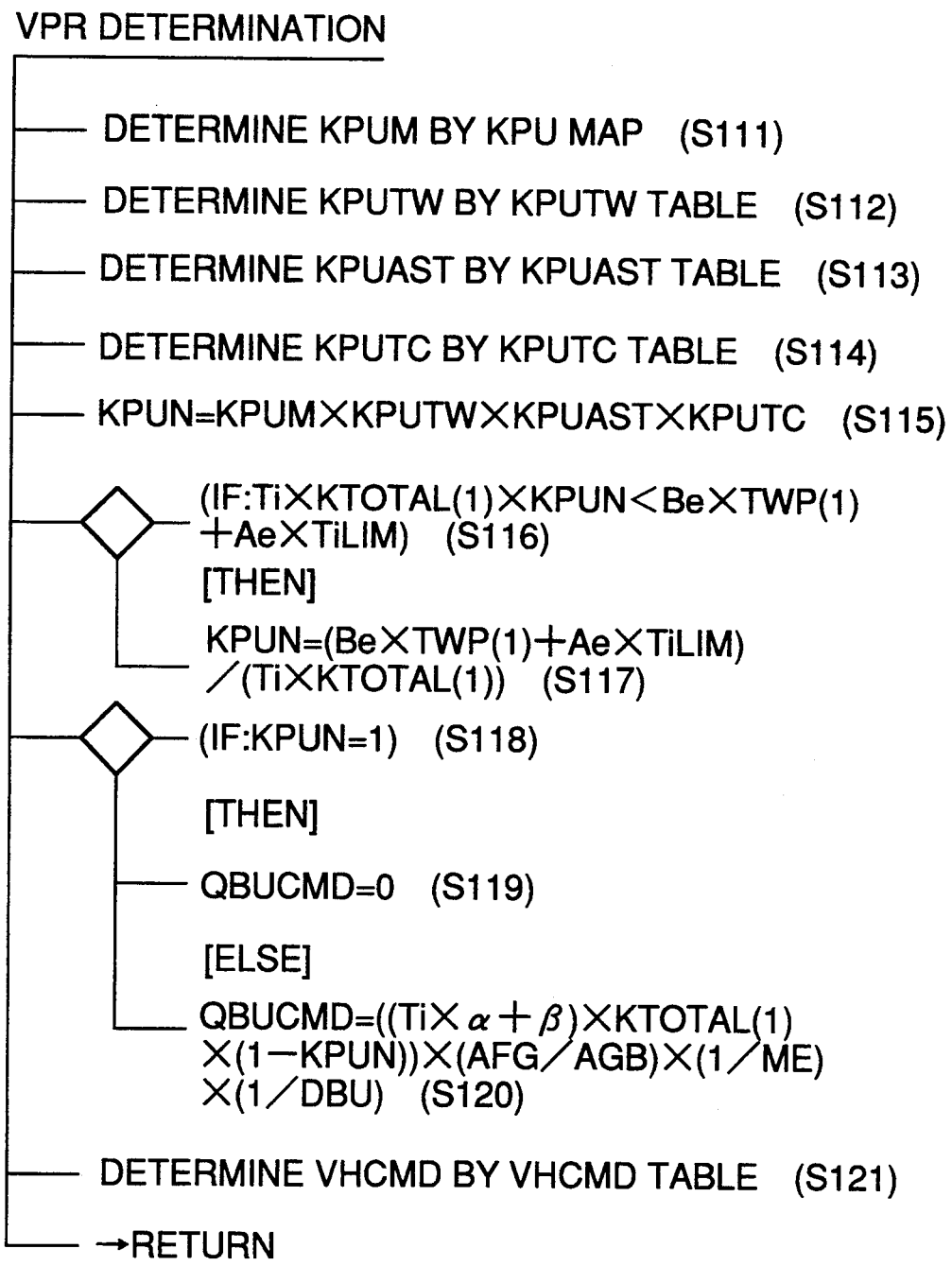
FIG. 19 shows a flowchart of a VPR-determining routine.

FIG. 19 shows a VPR-determining routine, which is executed in synchronism with generation of each TDC signal pulse.

At steps S111 to S115, the injection fuel decremental coefficient KPUN is calculated. The injection fuel decremental coefficient decreases the amount of fuel (gasoline) to be injected by the fuel injection valve 6, in view of the fact that butane as evaporative fuel is purged into the intake pipe 2 from the canister 33. First, at a step S111, a basic injected fuel decremental coefficient KPUM is determined by retrieving a KPU map.

The KPU map is set, e.g. as shown in FIG. 20, such that map values KPUM(0,0) to KPUM(16,19) are provided in a manner corresponding to predetermined values PBA0 to PBA16 of the intake pipe absolute pressure PBA and predetermined values ME00 to ME19 of the reciprocal of the engine rotational speed NE. The basic injection fuel decremental coefficient KPUM is determined by retrieving the KPU map, and additionally by interpolation, if required. In this connection, the coefficient KPUM is set to "1" when the flag FBCAL is equal to "0" inhibit the butane mass calculation.

Then, at a step S112, an engine coolant temperature-dependent correction coefficient KPUTW is determined by retrieving a KPUTW table.

Figure 21:
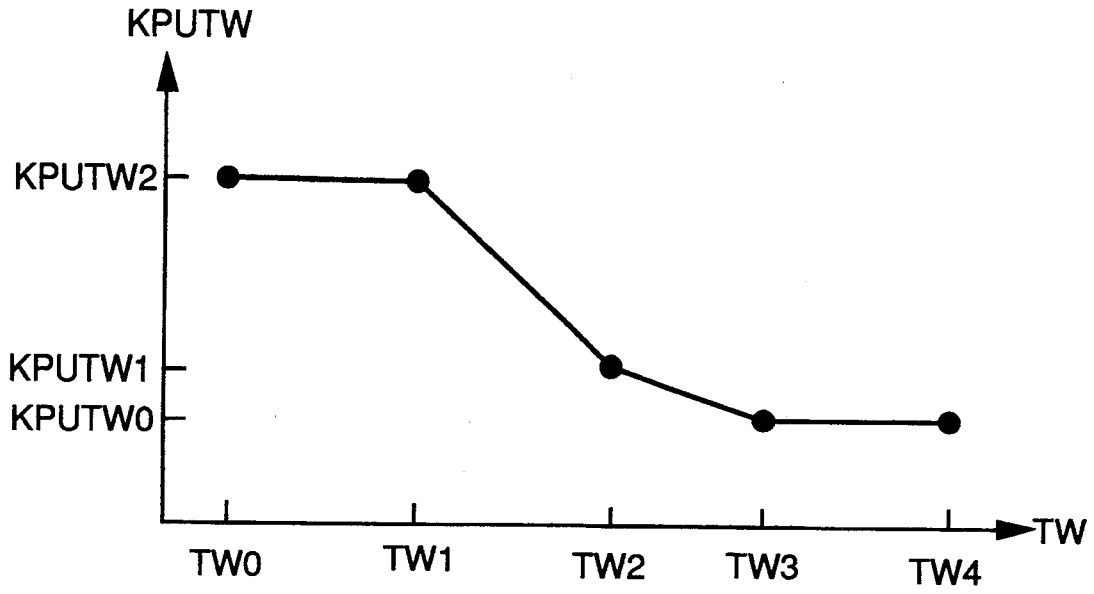
FIG. 21 shows a KPUTW table.

The KPUTW table is set, e.g. as shown in FIG. 21, such that table values KPUTW0 to KPUTW2 are provided in a manner corresponding to predetermined values TW0 to TW4 of the engine coolant temperature TW.

As shown in FIG. 21, according to the KPUTW table, the correction coefficient KPUTW is set to a larger value as the engine coolant temperature is lower, so as to allow a larger amount of fuel to be drawn into the combustion chamber, e.g. when the engine is started at a low temperature. The correction coefficient KPUTW is determined by retrieving the KPUTW table, and additionally by interpolation, if required. In this connection, the coefficient KPUTW is also set to "1" when the flag FBCAL is equal to "0".

Then, at a step S113, an after-start correction coefficient KPUAST is determined by retrieving a KPUAST table.

Figure 22:
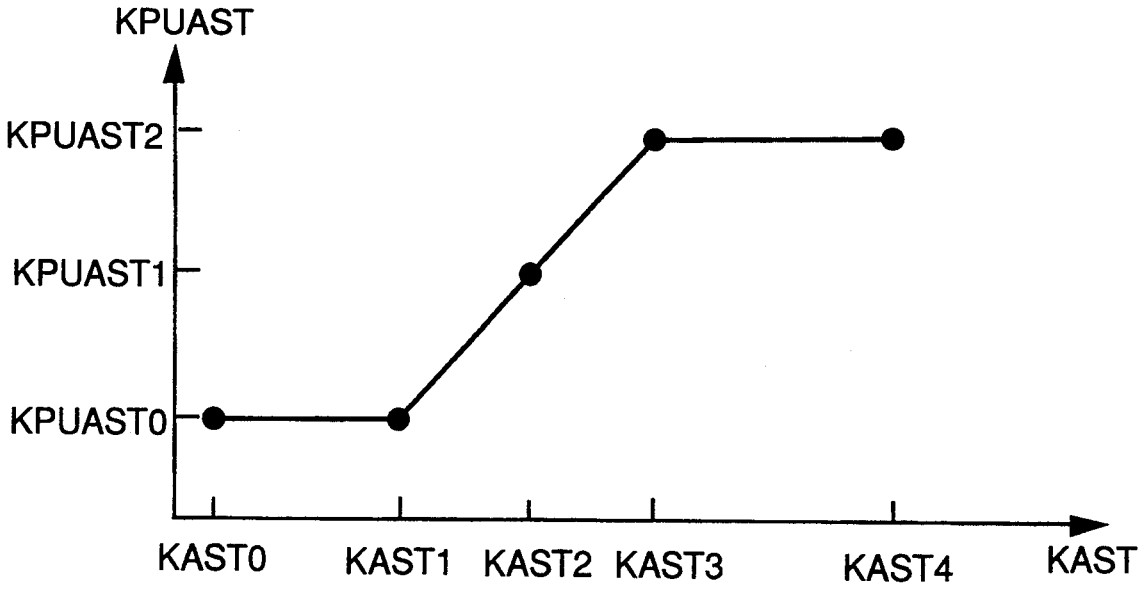
FIG. 22 shows a KPUAST table.

The KPUAST table is set, e.g. as shown in FIG. 22, such that table values KPUAST0 to KPUAST2 are provided in a manner corresponding to predetermined values KAST0 to KAST4 of an after-start enriching coefficient KAST. The after-start enriching coefficient KAST increases an amount of fuel supplied to the engine immediately after the start of the engine, which is set to a smaller value as time elapses after the start of the engine, and when the engine is in a normal operating condition, it is set to "1.0". As is clear from FIG. 22, when the after-start enriching coefficient KAST is large, i.e. when the fuel injection period is longer than at the start of the engine, the after-start correction coefficient KPUAST is set to a larger value. The after-start correction coefficient KPUAST is determined by retrieving the KPUAST table and additionally by interpolation, if required. In this connection, the correction coefficient KPUAST is set to "1" when FBCAL=0.

Then, at a step S114, a catalyst bed temperature-dependent correction coefficient KPUTC is determined by retrieving a KPUTC table.

Figure 23:
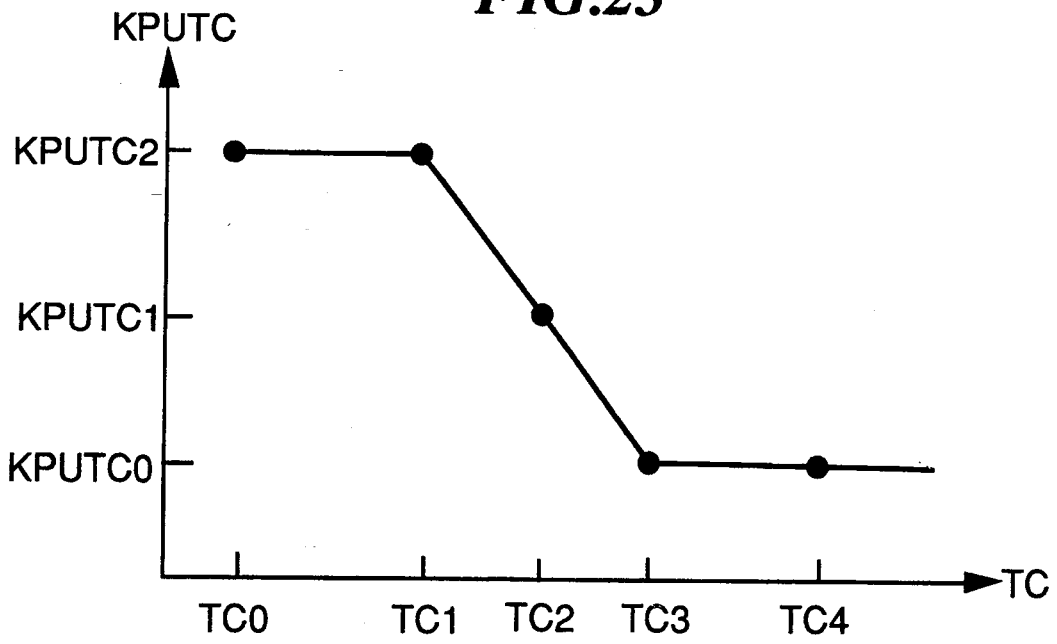
FIG. 23 shows a KPUTC table.

The KPUTC table is set, e.g. as shown in FIG. 23, such that table values KPUTC0 to KPUTC2 are provided in a manner corresponding to predetermined values TC0 to TC4 of the temperature TC of the catalyst bed. As shown in FIG. 23, according to the KPUTC table, the catalyst bed temperature-dependent correction coefficient KPUTC is set to a smaller value as the catalyst bed temperature TC increases so that the catalyst bed becomes more activated. This correction coefficient KPUTC is determined by retrieving the KPUTC table and additionally by interpolation, if required. This correction coefficient KPUTC is also set to "1" when FBCAL=0.

Then, at a step S115, the injection fuel decremental coefficient KPUN is obtained by multiplying the basic injection fuel decremental correction coefficient KPUM, the engine coolant temperature-dependent correction coefficient KPUTW, the after-start correction coefficient KPUAST, and the catalyst bed temperature-dependent correction coefficient KPUTC:

$$KPUN = KPUM \times KPUTW \times KPUAST \times KPUTC \quad (16)$$

Thus, except for the case where the flag FBCAL is equal to "0", i.e. when the butane mass calculation is inhibited, the engine temperature-dependent correction coefficient KPUTW, the after-start correction coefficient KPUAST and the catalyst bed temperature-dependent correction coefficient KPUTC are set to larger values immediately after the start of the engine than when the engine is in normal operation. Accordingly, a large amount of purged gas mainly composed of butane which is lighter than gasoline can be supplied to the combustion chamber immediately after the start of the engine at a low temperature, to thereby achieve excellent combustibility at a low engine temperature, and hence to achieve improved exhaust emission characteristics.

Then, at a step S116, limit check of an amount of gasoline injected by the fuel injection valve 6 is performed for the #1 cylinder as a representative of all the cylinders. More specifically, whether or not the valve opening period of the fuel injection valve 6 obtained by multiplying the required amount (Ti×KTOTAL(1)) of gasoline to be injected into the #1 cylinder by the injection fuel decremental correction coefficient KPUN is shorter than a predetermined lower value is determined by determining whether or not Equation (17) is satisfied:

$$Ti \times KTOTAL(1) \times KPUN < Be \times TWP(1) + Ae \times TiLIM \quad (17)$$

The left side of the equation represents the fuel injection period from which a predetermined amount of fuel is subtracted, depending upon an amount of evaporative fuel, and the first term on the right side represents an amount of fuel carried off into the combustion chamber during the present cycle, out of the adhering fuel amount TPW, and the second term on the right side represents the minimum amount of fuel directly drawn into the combustion chamber out of the amount of fuel injected during the present cycle. Be represents a final carry off ratio of gasoline, which means the ratio of an amount of fuel carried off from fuel (gasoline) adhering to the inner wall surface of the intake pipe 2 and drawn into the combustion chamber during the present cycle, to an amount of the fuel adhering to the inner wall surface of the intake pipe 2. Ae represents a final direct supply ratio of gasoline, which means the ratio of an amount of fuel injected and directly drawn into the combustion chamber during the present cycle to an amount of fuel injected from the fuel injection valve 6 during the present cycle. These final carry-off ratio and direct supply ratio of gasoline are determined by an LPARA-determining routine described hereinafter with reference to FIG. 29. TWP represents an amount of fuel adhering to the inner wall surface of the intake pipe 2, which is determined by executing a TWP-determining routine hereinafter described with reference to FIG. 38. TiLIM represents a predetermined lower limit value, which is a lower limit of the fuel injection period below which the linear relationship between the fuel injection period and the fuel injection amount Y is no longer maintained. More specifically, the fuel injection period is normally linear to the fuel injection amount. However, if the fuel injection period becomes extremely short, the above-mentioned linear relationship cannot be maintained any longer, so that the fuel injection amount may become uncontrollable. To avoid this inconvenience, the predetermined lower limit TiLIM is set no the lower limit of the fuel injection period below which the linear relationship between the fuel injection time period and the fuel injection amount Y cannot be maintained.

If Equation (17) is satisfied, the lower limit of the injection fuel decremental correction coefficient KPUN is calculated by the use of Equation (18) at a step S117:

$$KPUN=(Be\times TWP(1)+Ae\times TiLIM)/(Ti\times KTOTAL(1) \quad (18)$$

Then, at a step S118, it is determined whether or not the injection fuel decremental correction coefficient KPUN is equal to "1". If KPUN is equal to "1", it means that the flag FBCAL is equal to "0" to inhibit the butane mass calculation, so that a desired flow rate QBUCMD of butane is set to "0" at a step S119, followed by the program proceeding to a step S121.

On the other hand, if KPUN is not equal to "1", the program proceeds to a step S120, where the desired flow rate QBUCMD of butane as evaporative fuel, i.e. a desired flow rate of butane per unit time is calculated by the use of Equation (19):

$$QBUCMD=(Ti\times\alpha+\beta)\times KTOTAL(1)\times(1-KPUN)\times(AFB/AFB)\times(1/ME)\times(1/DBU) \quad (19)$$

Then, at a step S121, a desired output voltage VHCMD from the flowmeter 36 is determined by retrieving a VHCMD table.

Figure 24:
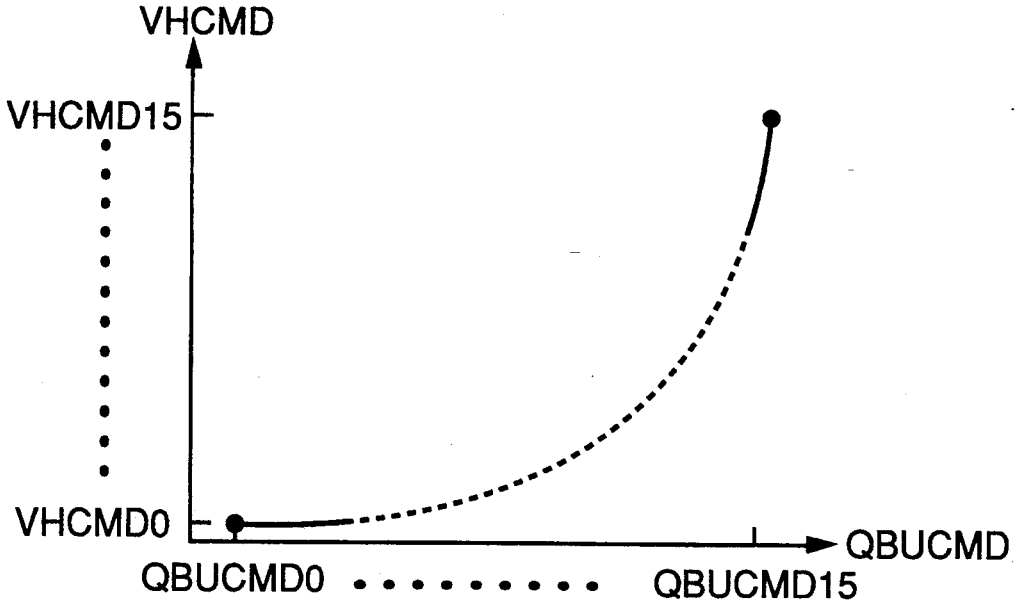
FIG. 24 shows a VHCMD table.

The VHCMD table is set, e.g. as shown in FIG. 24, such that table values VHCMD0 to VHCMD15 are provided in a manner corresponding to predetermined values QBUCMD0 to QBUCMD15 of the desired flow rate QBUCMD. The desired output voltage VHCMD from the flowmeter 36 is determined by retrieving the VHCMD table, and additionally by interpolation, if required.

Thus, the flow rate of purged gas is feedback-controlled based on the desired output voltage VHCMD from the flowmeter 36, enabling the canister 33 to maintain the desired adsorbing capability thereof without suffering supersaturation.

(8) Determination of the valve lift command value LPUCMD (at the step S9 of FIG. 3)

FIG. 25 shows the aforementioned LPUCMD-determining routine, which is executed in synchronism with generation of each TDC signal pulse.

First, at a step S131, there is calculated a difference ΔVH between the desired output voltage VHCMD (obtained at the step S121 of FIG. 19) and the output voltage (detected output voltage) VHACT from the flowmeter 36. Then, at a step S132, it is determined whether or not the difference ΔVH is lower than "0".

This determination contemplates a difference in the valve opening characteristic between when the purge control valve 37 is controlled to increase the flow rate of purged gas and when it is controlled to decrease same. The difference ΔVH results from the use of a spring, not shown, which urges the valving element 38 of the purge control valve 37 in a valve-closing direction. Accordingly, depending on the difference ΔVH, different rates of change (gain) of the valve lift command value LPUCMD are calculated to feedback-control the flow rate of purged gas.

More specifically, when the difference ΔVH is smaller than "0", i.e. when the purge control valve 37 is controlled in a flow rate-decreasing direction, determinations are made of control parameters for determining a rate of change in the valve lift command value LPUCMD, i.e. a proportional term (P-term) correction coefficient KVPD, an integral term (I-term) correction coefficient KVID, and a differential term (D-term) correction coefficient KVDD, for decreasing the flow rate of purged gas, at a step S133 by retrieving a KVPD map, a KVID map, and a KVDD map. The KVPD map, the KVID map, and the KVDD map are each set such that predetermined map values are provided in a manner corresponding to predetermined values of the engine rotational speed NE and predetermined values of the intake pipe absolute pressure PBA. These control parameters are determined by retrieving these maps according to these operating parameters of the engine, and additionally by interpolation, if required.

Then, at steps S134 to S136, desired correction values VHP(n), VHI(n), and VHD(n) for the P-term, I-term, and D-term are calculated by the use of Equations (20) to (22), respectively:

$$VHP(n)=\Delta VH(n)\times KVPD \quad (20)$$

$$VHI(n)=\Delta VH(n)\times KVID+VHI(n-1) \quad (21)$$

$$VHD(n)-(\Delta VH(n)-\Delta VH(n-1)\times KVDD \quad (22)$$

On the other hand, if the difference ΔVH is equal to or larger than "0", the program proceeds to a step S137, where determinations are made of control parameters for determining a rate of change in the valve lift command value LPUCMD, i.e. a proportional term (P-term) correction coefficient KVPU, an integral term (I-term) correction coefficient KVIU, and a differential term (D-term) correction coefficient KVDU, for increasing the flow rate of purged gas, by retrieving a KVPU map, a KVIU map, and a KVDU map. The KVPU map, the KVIU map, and the KVDU map are each set, similarly to the above KVPD map, KVID map and KVDD map, such that predetermined map values are provided in a manner corresponding to predetermined values of the engine rotational speed NE and predetermined values of the intake pipe absolute pressure PBA. These control parameters are determined by retrieving these maps according to the operating parameters of the engine, and additionally by interpolation, if required.

Then, at steps S138 to S140, desired correction values VHP(n), VHI(n), and VHD(n) for the P-term, I-term, and D-term are calculated by the use of Equations (23) to (25), respectively:

$$VHP(n)=\Delta VH(n)\times KVPU \quad (23)$$

$$VHI(n)=\Delta VH(n)\times KVIU+VHI(n-1) \quad (24)$$

$$VHD(n)=(\Delta VH(n)-\Delta VH(n-1)\times KVDU \quad (25)$$

Then, at a step S141, a desired correction value VHOBJ(n) of the output voltage from the flowmeter 36 is calculated by adding together these desired correction values VHP(n), VHI(n), and VHD(n) by the use of Equation (26):

$$VHOBJ(n)=VHP(n)+VHI(n)+VHD(n) \quad (26)$$

Then, at a step S142, a desired purging flow rate QPUCMD is determined by retrieving a QPUCMD table.

Figure 26:
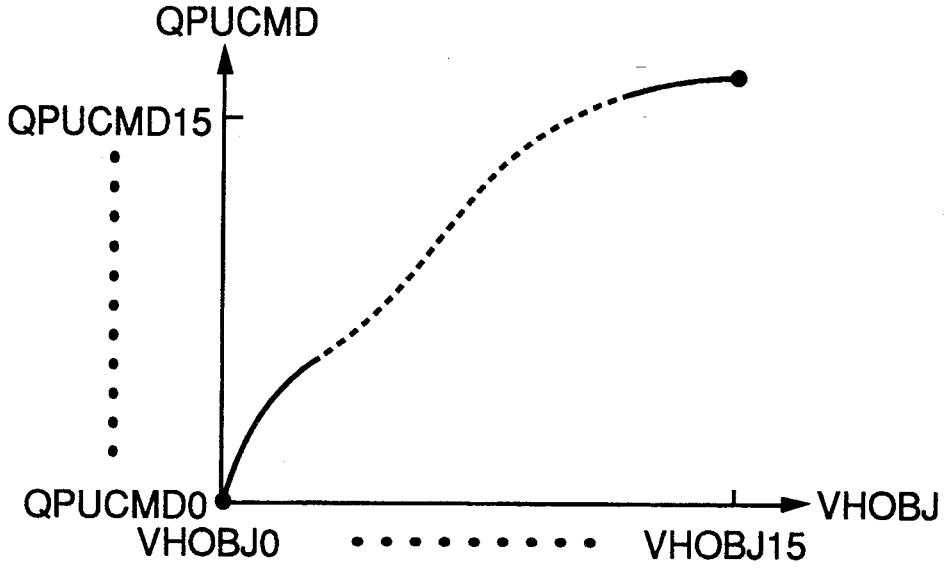
FIG. 26 shows a QPUCMD table.

The QPUCMD table is set, e.g. shown in FIG. 26, such that table values QPUCMD0 to QPUCMD15 are provided in a manner corresponding to predetermined values VHOBJ0 to VHOBJ15 of the above desired correction value VHOBJ. The desired purging flow rate QPUCMD is determined by retrieving the QPUCMD table and additionally by interpolation, if required.

Then, at a step S143, the valve lift command value LPUCMD for the purge control valve 37 is determined by retrieving an LPUCMD map, followed by terminating the program.

The LPUCMD map is set, e.g. as shown in FIG. 27, such that map values LPUCMD(00,00) to LPUCMD(15,15) are provided in a manner corresponding to predetermined values PBA00 to PBA15 of the intake pipe absolute pressure PBA and predetermined values QPUCMD00 to QAPUCMD15 of the desired purging flow rate. The valve lift command value LPUCMD is determined by retrieving the LPUCMD map, and additionally by interpolation, if required.

Thus, the valve lift command value LPUCMD is determined based on the desired purging flow rate QPUCMD, whereby the valving element 38 is lifted to open the purge control valve 37 according to the valve lift command value LPUCMD to allow a desired amount of purged gas to be supplied to the engine.

[B] Adhering fuel-dependent correction processing.

The required fuel injection period TREQ(k) (see FIG. 17) determined by the evaporative fuel processing described heretofore does not take into account the influence of an amount of gasoline as injected fuel adhering to the inner wall surface of the intake pipe 2 before being supplied to the combustion chamber. Therefore, a desired fuel injection period TNET(k) must be determined with the adhering fuel taken into consideration.

Next, the adhering fuel-dependent correction processing will be described in detail.

Figure 28:
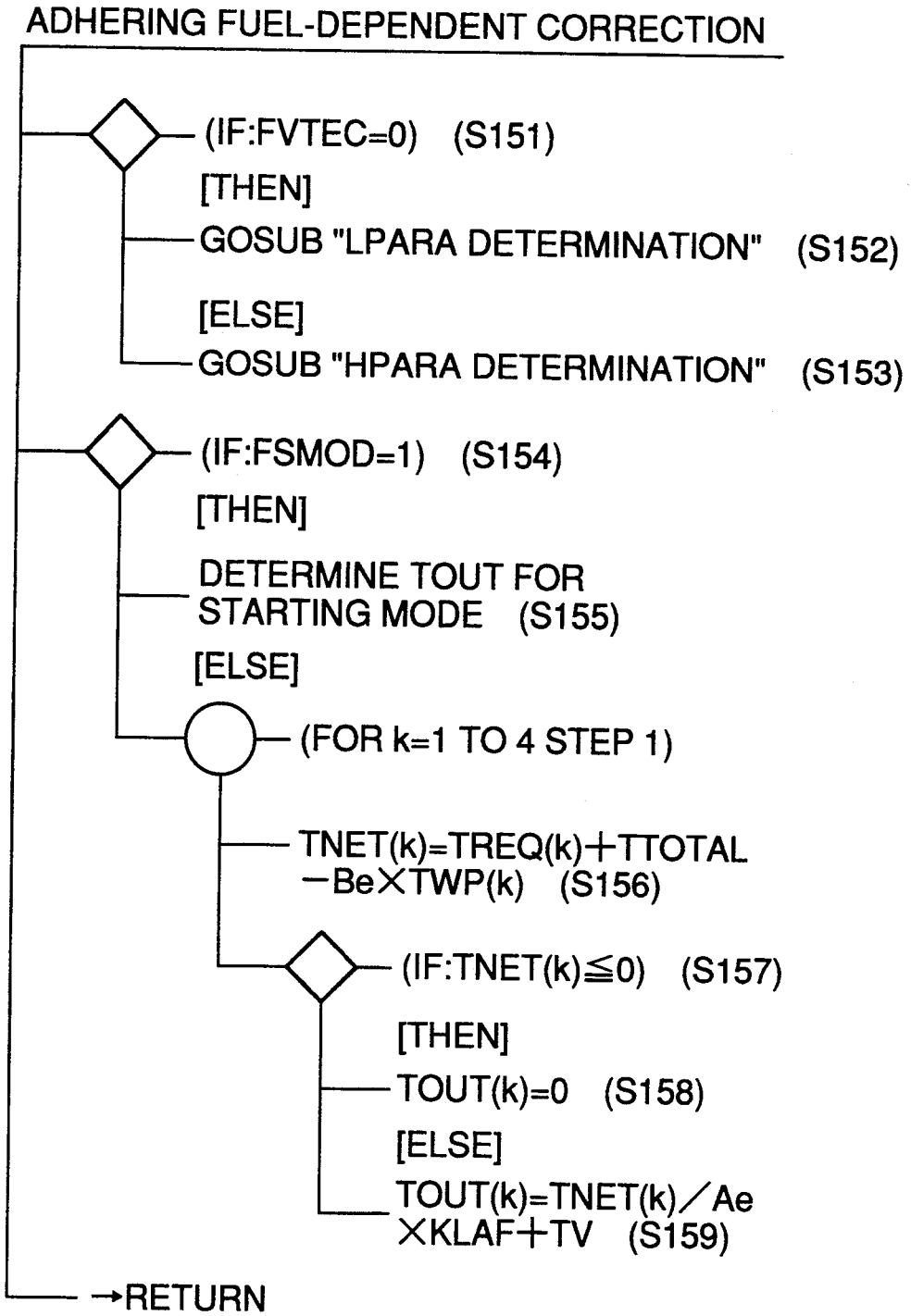
FIG. 28 shows a flowchart of an adhering fuel-dependent correction routine.

FIG. 28 shows a routine for carrying out the adhering fuel-dependent correction processing, which is executed in synchronism with generation of each TDC signal pulse.

First, at a step S151, it is determined whether or not a flag FVTEC is equal to "0", i.e. whether the valve timing is selected to the low speed V/T. If FVTEC=0, i.e. if it is determined that the valve timing is selected to the low speed V/T, the aforementioned LPARA-determining routine is performed at a step S151 to determine adhering fuel-determining parameters suitable for the low speed V/T, i.e. a value of the final direct supply ratio Ae and a value of the final carry-off ratio Be of gasoline as injected fuel for use in fuel injection control during the low speed V/T.

Figure 29:
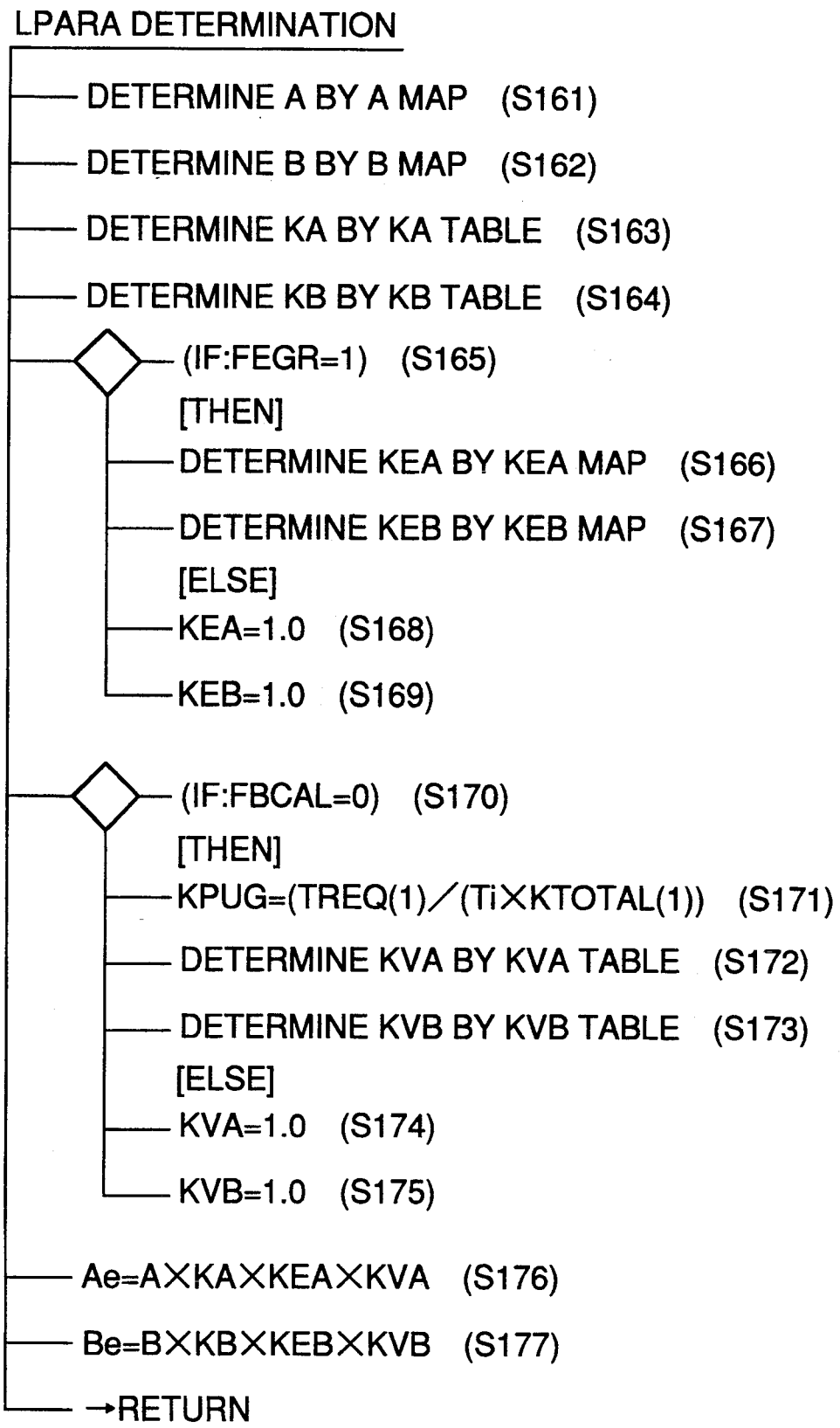
FIG. 29 shows a flowchart of an LPARA-determining routine.

FIG. 29 shows the LPARA-determining routine for determining the above-mentioned adhering fuel-determining parameters, which is executed in synchronism with generation of each TDC signal pulse.

First, at a step S161, a basic direct supply ratio A is determined by retrieving an A map.

The A map is set, e.g. as shown in FIG. 30, such that map values A(0,0) to A(6,6) are provided in a manner corresponding to predetermined values PBA0 to PBA6 of the intake pipe absolute pressure PBA and predetermined values TW0 to TW6 of the engine coolant temperature TW. The basic direct supply ratio A is determined by retrieving the A map, and additionally by interpolation, if required.

Then, at a step S162, a basic carry-off ratio B is determined by retrieving a B map.

The B map is set similarly to the A map, e.g., as shown in FIG. 31, such that map values B(0,0) to B(6,6) are provided in a manner corresponding to predetermined values PBA0 to PBA6 of the intake pipe absolute pressure PBA and predetermined values TW0 to TW6 of the engine coolant temperature TW. The basic carry-off ratio B is determined by retrieving the B map, and additionally by interpolation, if required.

Then, at a step S163, an engine speed-dependent correction coefficient KA for the final direct supply Ae is determined by retrieving a KA table.

Figure 32:
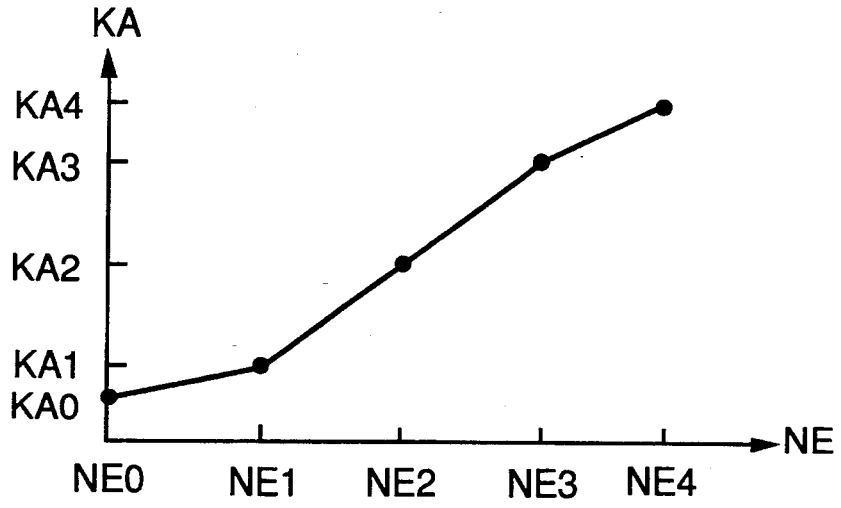
FIG. 32 shows a KA table.

The KA table is set, e.g. as shown in FIG. 32, such that table values KA0 to KA4 are provided in a manner corresponding to predetermined values NE0 to NE4 of the engine rotational speed NE. The engine speed-dependent correction coefficient KA is determined by retrieving the KA table, and additionally by interpolation, if required.

Then, at a step S164, an engine speed-dependent correction coefficient KB for the final carry-off ratio Be is determined by retrieving a KB table.

Figure 33:
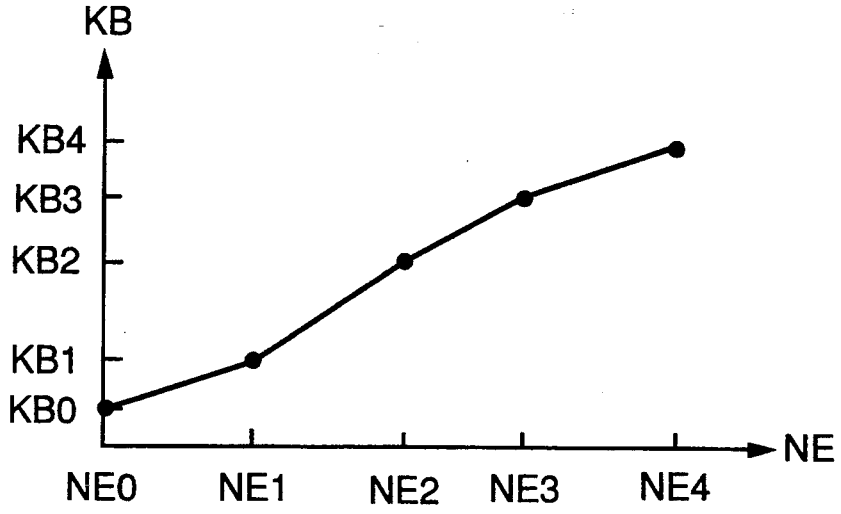
FIG. 33 shows a KB table.

The KB table is set similarly to the KA table, e.g. as shown in FIG. 33, such that table values KB0 to KB4 are provided in a manner corresponding to predetermined values NE0 to NE4 of the engine rotational speed NE. The engine speed-dependent correction coefficient KB is determined by retrieving the KB table, and additionally by interpolation, if required.

Then, at a step S165, it is determined whether or not a flag FEGR is equal to "1", i.e. whether or not the engine is in an EGR-performing region. Whether the engine is in the EGR-performing region is determined by determining whether the engine coolant temperature TW is above a predetermined value to be assumed when the engine has been warmed up, more specifically, by executing an EGR-performing region-determining routine. If FEGR=1, i.e. if the engine is determined to be in the EGR-performing region, the program proceeds to a step S166, where an EGR-dependent correction coefficient KEA for the final direct supply ratio Ae is determined by retrieving a KEA map.

The KEA map is set, e.g. as shown in FIG. 34, such that map values KEA(0,0) to KEA(6,4) are provided in a manner corresponding to predetermined values PBA0 to PBA6 of the intake pipe absolute pressure PBA and predetermined values KEGR0 to KEGR4 of the EGR-dependent correction coefficient KEGR. The EGR-dependent correction coefficient KEA is determined by retrieving the KEA map, and additionally by interpolation, if required.

Then, at a step S167, an EGR-dependent correction coefficient KEB for the final carry-off ratio Be is determined by retrieving a KEB map.

The KEB map is set, e.g. as shown in FIG. 35, such that map values KEB(0,0) to KEB(6,4) are provided in a manner corresponding to predetermined values PBA0 to PBA6 of the intake pipe absolute pressure PBA and predetermined values KEGR0 to KEGR4 of the EGR-dependent correction coefficient KEGR. The EGR-dependent correction coefficient KEB is determined by retrieving the KEB map, and additionally by interpolation, if required.

If FEGR=0, i.e. if it is determined that the engine is not in the EGR-performing region, the EGR-dependent correction coefficients KEA, KEB are both set to "1.0" at steps S168 and S169, respectively.

Then, the program proceeds to a step S170, where it is determined whether the flag FBCAL is equal to "1", i.e. whether the control system is in the butane mass-calculating mode. If FBCAL=1, i.e. if the control system is in the butane mass-calculating mode in which butane as evaporative fuel is supplied to the intake pipe 2 via the purging passage 10, the program proceeds to a step S171, where an injection fuel ratio KPUG, i.e. the ratio of the required fuel injection period TREQ to a fuel injection period (Ti×KTOTAL) required when the purging flow rate is equal to "0" is calculated by the use of Equation (27):

$$KPUG = TREQ(1)/(Ti \times KTOTAL(1)) \quad (27)$$

In the equation, (1) represents the #1 cylinder, i.e. this calculation is carried out only for the #1 cylinder as a representative of all the four cylinders.

Then, at steps S172 and S173, butane-dependent correction coefficients KVA and KVB for the final direct supply ratio Ae and the final carry-off ratio Be are calculated. These correction coefficients are employed to compensate for a variation in the fluid properties of injected fuel or gasoline (gasoline) due to the fact that butane is mixed with air in the intake pipe in various concentrations. That is, these correction coefficients correct the direct supply ratio and the carry-off supply ratio in a manner responsive to a change in dynamic characteristics of injected fuel (gasoline) caused by inclusion of butane.

More specifically, at a step S172, the butane-dependent correction coefficient KVA for the final direct supply ratio Ae is determined by retrieving a KVA table.

Figure 36:
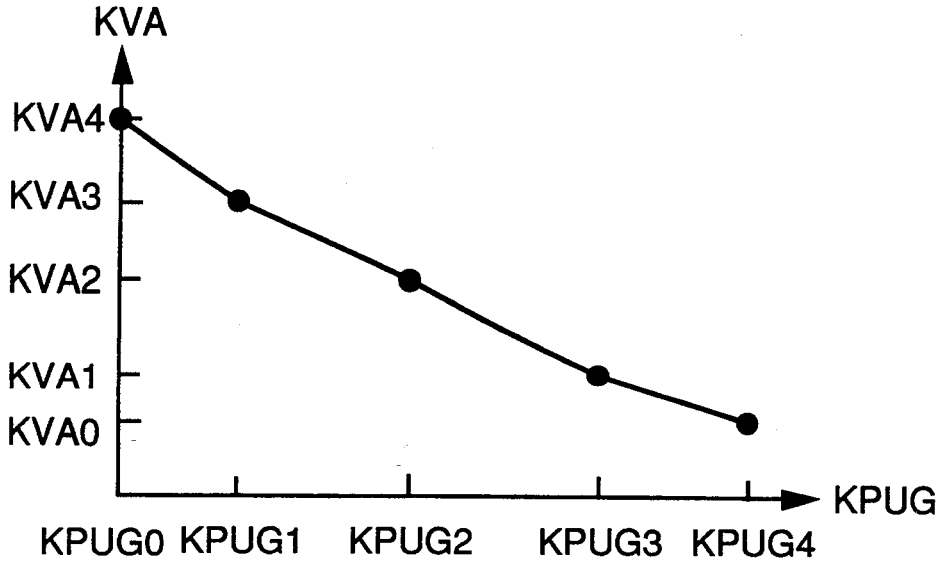
FIG. 36 shows a KVA table.

The KVA table is set, e.g. as shown in FIG. 36, such that table values KVA0 to KVA4 are provided in a manner corresponding to predetermined values KPUG0 to KPUG4. The butane correction coefficient KVA is determined by retrieving the KVA table, and additionally by interpolation, if required.

Then, at a step S173, the butane-dependent correction coefficient KVB for the final carry-off ratio Be is determined by retrieving a KVB table.

Figure 37:
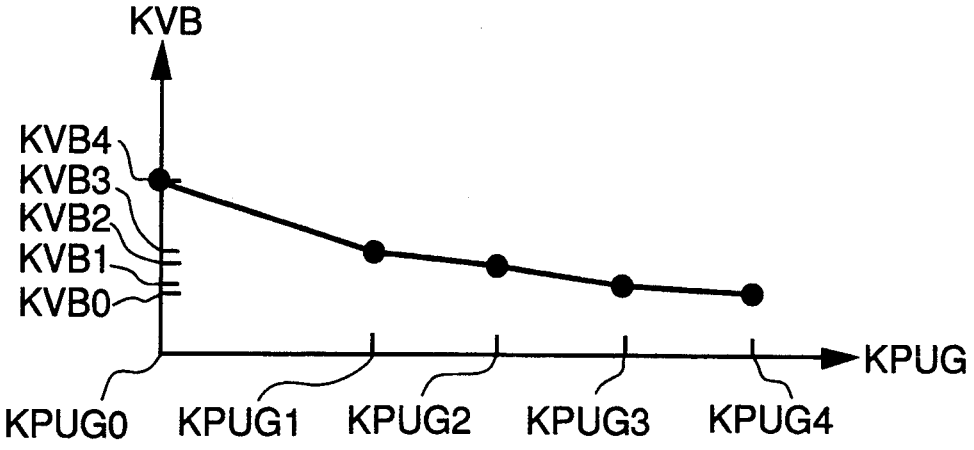
FIG. 37 shows a KVB table.

The KVB table is set, e.g. as shown in FIG. 37, such that table values KVB0 to KVB4 are provided in a manner corresponding to predetermined values KPUG0 to KPUG4 of the injected fuel ratio KPUG. The butane correction coefficient KVB is determined by retrieving the KVB table and additionally by interpolation, if required.

On the other hand, if the flag FBCAL is equal to "0", which means that the control system is in a butane mass calculation-inhibiting mode in which no butane or evaporative fuel is purged into the intake pipe 2. Therefore, the butane-dependent correction coefficients KVA and KVB are both set to "1.0" at steps S174 and S175, respectively.

Then, at steps S176 and S177, the final direct supply ratio Ae and the final carry-off ratio Be are calculated by the use of Equations (28) and (29), respectively, followed by terminating the routine and returning to the FIG. 28 main routine:

$$Ae = A \times KA \times KEA \times KVA \quad (28)$$

$$Be = B \times KB \times KEB \times KVB \quad (29)$$

Then, if it is determined at the step S151 of FIG. 28 that the flag FVTEC is equal to "1". The program proceeds to a step S153, where a HPARA-determining routine, not shown, is executed to determine adhering fuel-determining parameters suitable for the high speed V/T, i.e. a value of the final direct supply ratio Ae and a value of the final carry-off ratio Be of gasoline as injected fuel for use in fuel injection control during the high speed V/T.

Then, the program proceeds to a step S154, where it is determined whether or not a flag FSMOD is equal to "1". If FSMOD=1, it is judged that the engine is in the starting mode, and then the program proceeds to a step S155, where a final fuel injection period TOUT suitable for the starting mode is calculated by the use of Equation (30):

$$TOUT = TiCR \times K1 + K2 \quad (30)$$

where TiCR represents a basic fuel injection period suitable for the starting mode, which is determined, similarly to the aforementioned TiM value, according to the engine rotational speed NE and the intake pipe absolute pressure PBA. A TiCR map used for determining a TiCR value is stored into the ROM of the memory means 5c.

K1 and K2 represent other correction coefficients and correction variables, respectively, which are set depending on operating conditions of the engine to such values as optimize operating characteristics of the engine, such as fuel consumption and accelerability.

On the other hand, if the flag FSMOD is equal to "0", i.e. if the engine is in the basic operating mode, steps S156 et seq. are executed for each of the cylinders (#1CYL to #4CYL).

More specifically, first at a step S156, with respect to the #1 cylinder, the desired fuel injection period TNET(k) is calculated by the use of Equation (31).

$$TNET(k)=TREQ(k)+TTOTAL-Be\times TWP(k) \quad (31)$$

where TTOTAL represents the sum of all addend correction coefficients (e.g. atmospheric pressure-dependent correction coefficient TPA) which are determined based on engine operating parameter signals from various sensors. However, a so-called ineffective time period TV elapsed before the fuel injection valve 6 opens is not included therein. TWP(k) represents an amount (estimated) of fuel adhering to the inner wall surface of the intake pipe 2 calculated according to a routine described hereinafter with reference to FIG. 38, and hence (Be×TWP(k)) represents an amount of fuel carried off from the adhering fuel into the combustion chamber. This carried-off amount of the adhering fuel need not be newly supplied by injection, and hence is subtracted from the required amount of fuel TREQ(k) according to Equation (31).

At a step S157, it is determined whether or not the desired fuel injection period TNET(k) is smaller than "0". If TNET≦0, the final fuel injection period TOUT is set to "0" to forcibly interrupt the fuel supply at a step S158, followed by terminating the program. If TNET>0, the final fuel injection period TOUT is calculated at a step S159 by the use of Equation (32):

$$TOUT(k)=TNET(k)/(Ae\times KLAF)+TV \quad (32)$$

where KLAF represents an air-fuel ratio correction coefficient determined based on the output from the LAF sensor 29, and TV the aforementioned ineffective time period of the fuel injection valve 6.

By opening the fuel injection valve 6 over the final fuel injection period TOUT calculated by Equation (32), fuel is supplied to the combustion chamber in an amount of (TNET(k)×KLAF+Be×TWP(k)).

Thus, the fuel injection period is calculated for the #1 cylinder, and then the steps S156 to S159 are carried out similarly for the #2 cylinder to #4 cylinder as well to determine the final fuel injection period TOUT for all the cylinders.

Figure 38:
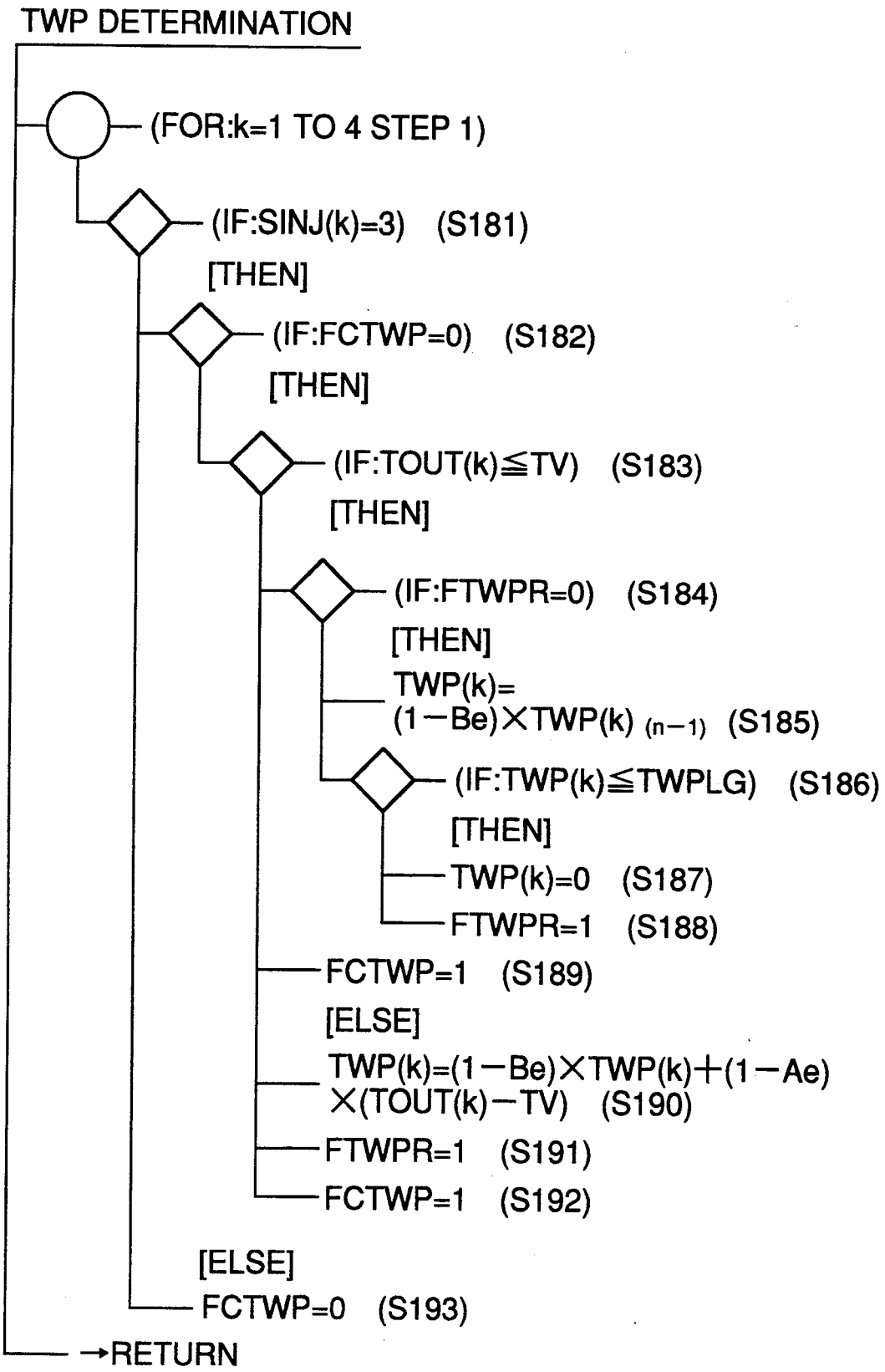
FIG. 38 shows a flowchart of a TWP-determining routine.

FIG. 38 shows a TWP-determining routine for determining the amount TWP of adhering fuel, which is executed for each cylinder whenever the crankshaft rotates through a predetermined angle (e.g. 30 degrees).

First, it is determined at a step S181 whether or not the status number SINJ(k) (see FIG. 2) is equal to "3", which indicates termination of fuel injection.

If SINJ(k) is not equal to 3, a calculation-permitting flag FCTWP is set to "0" at a step S193 to allow the calculation of the adhering amount TWP to be started in a subsequent loop, whereas if SINJ is equal to 3, it is determined at a step S182 whether or not the flag FCTWP is equal to "0". If FCTWP is equal to "0", it is determined at a step S183 whether or not the final fuel injection period TOUT(k) is smaller than the ineffective time period TV. If TOUT(k)≦TV, which means that no fuel is to be injected, it is determined at a step S184 whether or not a flag FTWPR is equal to "0", which means that the adhering amount TWP(k) of fuel is not negligible or zero. If FTWPR is equal to "0" and hence the adhering amount TWP of fuel is not negligible or zero, the program proceeds to a step S185, where the adhering amount TWP(k) of fuel in the present loop is calculated by the use of Equation (33):

$$TWP(k)=(1-Be)\times TWP(k)(n-1) \quad (33)$$

where TWP(k) (n−1) represents an adhering amount of fuel calculated in the immediately preceding loop.

Then, it is determined at a step S186, whether or not the adhering amount TWP(k) of fuel is equal to or smaller than a predetermined very small value TWPLG. If TWP(k)≦TWPLG, it is judged that the adhering amount TWP(k) is negligible or zero, so that the adhering amount TWP(k) is set to "0" at a step S187 and the flag FTWPR is set to "1" at a step S188. Then, at a step S189, the flag FCTWP is set to "1" to indicate completion of the calculation of the adhering amount TWP of fuel, followed by terminating the program.

On the other hand, if TOUT(k)>TV at the step S183, which means that fuel is to be injected, so that the program proceeds to a step S190, where the adhering amount TWP(k) is calculated by the use of Equation (34):

$$TWP(k)=(1-Be)\times TWP(k)(n-1)+(1-Ae)\times(TOUT(k)-TV) \quad (34)$$

where TWP(k)(n−1) represents the immediately preceding value of the adhering amount TWP(k). The first term on the right side represents an amount of fuel which has not been carried off from the adhering fuel and remains on the inner wall surface of the intake pipe during the present cycle, and the second term on the right side represents an amount of fuel corresponding to a portion of injected fuel which has not been drawn into the combustion chamber and newly adhered to the inner wall surface of the intake pipe 2.

Then, the flag FTWPR is set to "1" to indicate that the adhering amount TWP of fuel is still present at a step S191, and further the flag FCTWP is set to "1" to indicate completion of the calculation of the adhering amount TWP of fuel at a step S192, followed by terminating the program.

[II] Auxiliary Air Amount Control

Figure 39:
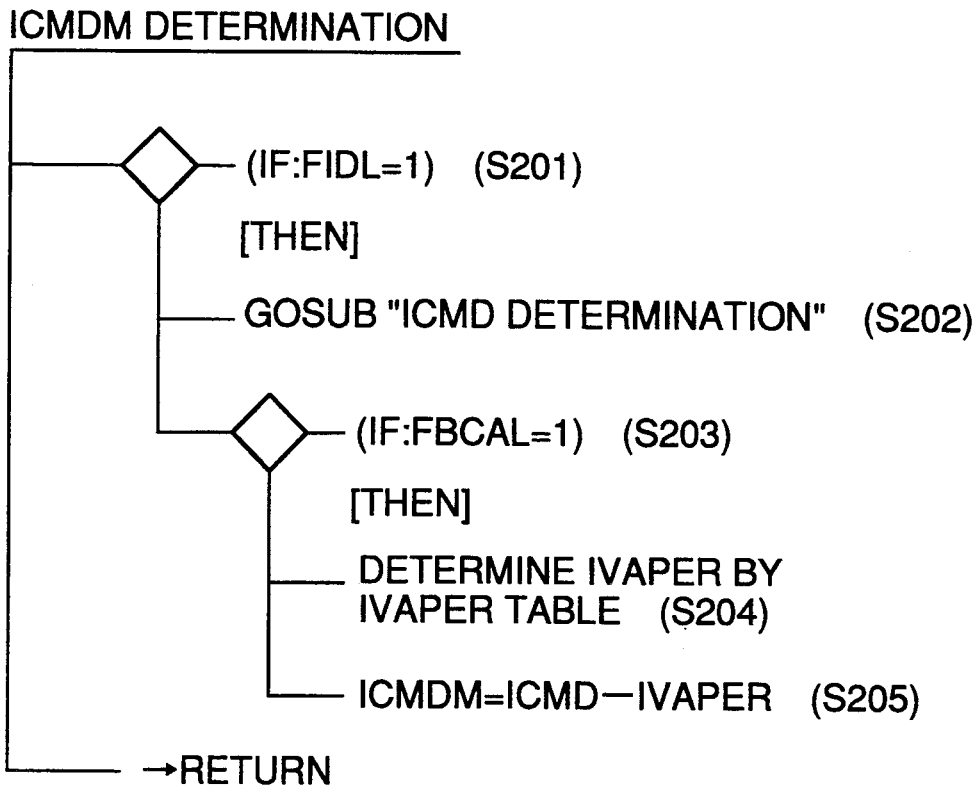
FIG. 39 shows a flowchart of an ICMDM-determining routine.
Figure 40:
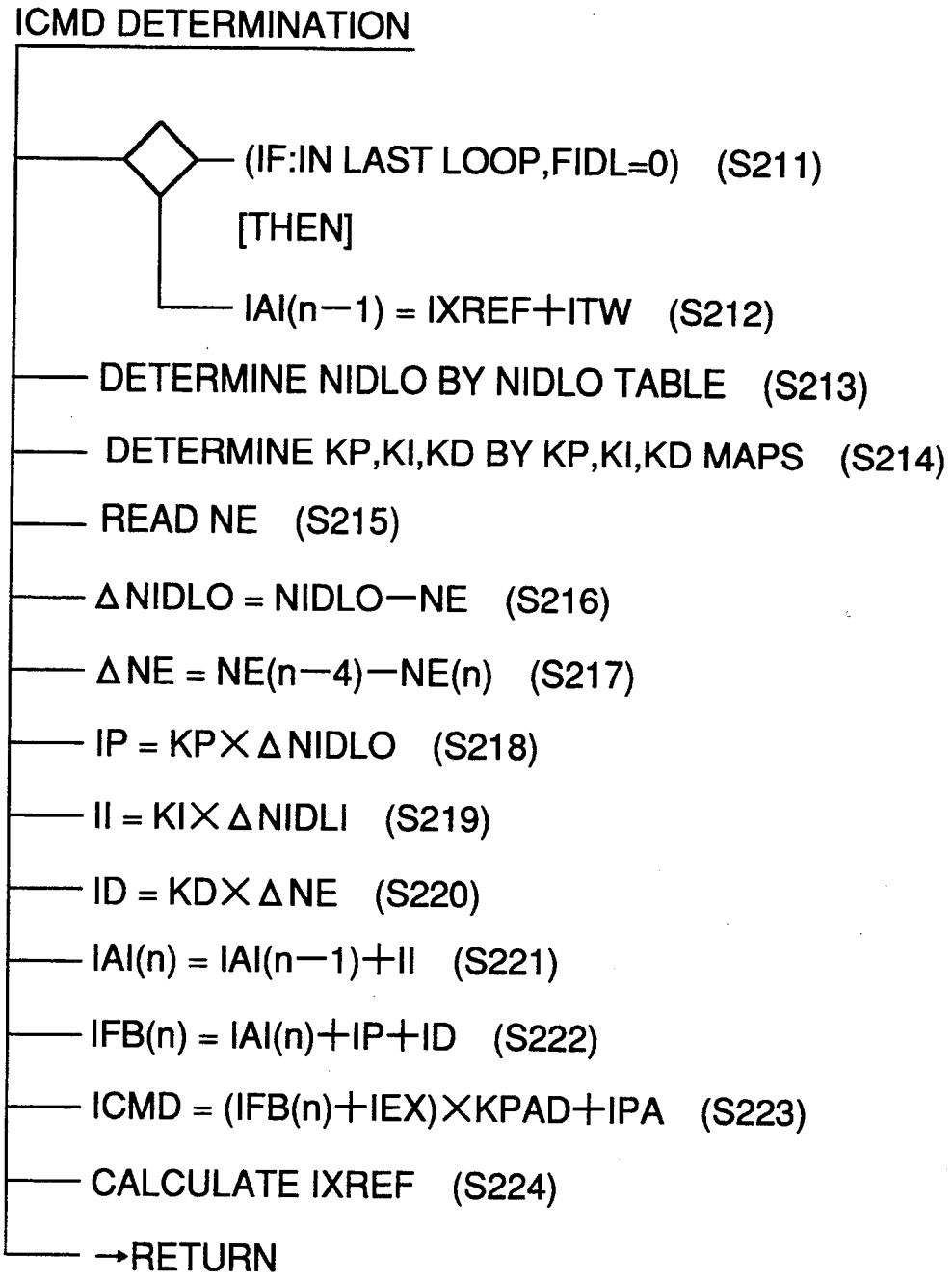
FIG. 40 shows a flowchart of an ICMD-determining routine.

FIG. 39 shows the ICMDM-determining routine for determining the valve lift command value ICMDM for controlling the opening of the AIC valve 11, which is executed upon generation of each TDC signal pulse.

First, it is determined at a step S201 whether or not a flag FIDL is equal to "1" to thereby determine whether the engine is in an idling feedback control mode in which the amount of auxiliary air is controlled in a feedback manner when the engine is idling. It is determined that the engine is in the idling feedback control mode, when it is determined e.g. that the engine rotational speed NE is lower than a predetermined value (e.g. 900 rpm) and the valve opening θTH of the throttle valve 3', detected by the θTH sensor 4, is smaller than a predetermined value θ id1 below which the valve opening θTH is to fall when the engine is idling, or alternatively that the engine rotational speed NE is lower than the predetermined value and at the same time the intake pipe absolute pressure PBA, detected by the PBA sensor 17, is lower than (on a lower load side of) a predetermined value.

If the engine is not in the idling feedback control mode (i.e. if FIDL=0), the program is immediately terminated, whereas if the engine is in the idling feedback control mode (i.e. if FIDL=1), the program proceeds to a step S202, where a basic valve lift command value ICMD is determined. The basic valve lift command value ICMD is determined, e.g. by carrying out an ICMD-determining routine shown in FIG. 10.

More specifically, it is determined at a step S211 of the ICMD-determining routine whether or not: the flag FIDL was equal to "0" in the immediately preceding loop, i.e. whether or not the auxiliary air amount feedback control was not performed in the immediately preceding loop. This determination is effected to thereby determine whether or not an integral term IAI(n−1) of a feedback control value IFB(n) determined at a step S222, referred to hereinafter, should be initialized.

Then, if the flag FIDL was equal to "0" in the immediately preceding loop, it is judged that the auxiliary air amount control has changed from the open-loop control mode to the feedback control mode after the immediately preceding loop, so that at a step S212, the integral term IAI(n−1) is initialized in a manner described hereinafter, followed by the program proceeding to a step S213. On the other hand, if the flag FIDL was already equal to "1" in the immediately preceding loop, it is judged that the auxiliary air amount control has continued to be in the feedback control mode from the immediately preceding loop, and the program directly proceeds to the step S213 without initializing the integral term IAI (n−1).

The initialization of the integral term IAI(n−1) is carried out by the use of Equation (35), i.e. by adding an idling coolant temperature-dependent correction value ITW, which is set depending on the engine coolant temperature TW during idling of the engine, to a learned value (average value) IXREF of the integral term IAI(n) calculated when the engine is in a predetermined operating condition, described hereinafter.

$$IAI(n-1)=IXREF+ITW \tag{35}$$

The idling engine coolant temperature-dependent correction vale ITW is read according to the engine coolant temperature TW from a TW-ITW table, not shown, which is stored in the memory means 5c and set such that the correction value ITW assumes a smaller value as the engine coolant temperature TW rises.

Then, a desired idling speed NIDL0 is determined at the step S213 and control gains for the air-fuel ratio feedback control are calculated at a step S214.

More specifically, at the step S213, the desired idling speed NIDL0 is determined by retrieving an NIDL0 table which is set such that the desired idling speed NIDL0 assumes a smaller value as the engine coolant temperature TW rises. The desired idling speed NIDL0 is read from the NIDL0 table, and additionally by interpolation, if required.

At the step S214, a KP map, a KI map, and a KD map are retrieved to determine the control gains of the auxiliary air amount feedback control during idling; a proportional term (P-term) coefficient KP, an integral (term I-term) coefficient KI, and a differential term (D-term) coefficient KD.

Then, at a step S215, the engine rotational speed NE, detected by the CRK sensor 20, is read, and then at steps S216 and S217, there are calculated a difference ΔNIDL0 between the engine rotational speed NE and the desired idling speed NIDL0, and a difference ΔNE between the present value NE(n) of the engine rotational speed detected during the present loop and a value NE(n−4) of same detected four TDC signal pulses earlier.

Then, at steps S218 to S220, a correction value IP for the proportional term, a correction value II for the integral term, and a correction value ID for the differential term for use in the feedback control are calculated by the use of Equations (36) to (38):

$$IP=KP\times\Delta NIDL0 \tag{36}$$

$$II=KI\times\Delta NIDL0 \tag{37}$$

$$ID=KD\times\Delta NE \tag{38}$$

Then, the program proceeds to a step S221, where the correction value II for the integral term calculated at the step S219 is added to a value IAI(n−1) of the integral term (an initial value of the integral term set at the step S202 or a value of same calculated in the immediately following loop after initialization) according to Equation (39) to calculate the present value IAI(n) of the integral term, and then the program proceeds to a step S222, where the correction value IP for the proportional term and the correction value ID for the differential term are added to the integral term IAI(n) calculated at the step S221 according to Equation (40) to calculate the present value of the feedback control value IFBn. Then, at a step S223, the basic valve lift command value ICMD is calculated by the use of the feedback control value IFBn according to Equation (41).

$$IAI(n)=IAI(n-1)+II \tag{39}$$

$$IFB(n)=IAI(n)+IP+ID \tag{40}$$

$$ICMD=(IFB(n)+IEX)\times KPAD+IPA \tag{41}$$

where IEX represents an electric load-dependent correction term for compensating for influence of operations of electric devices driven by the engine, such as an air-conditioner.

Further, KPAD represents an atmospheric pressure-dependent correction coefficient provided for compensating for variation in the amount of intake air, drawn into the combustion chamber via the AIC control valve 11, which is caused by variation in the atmospheric pressure. IPA represents an atmospheric pressure-dependent correction variable for correcting an amount of intake air drawn into the combustion chamber via a path other than that through the AIC control valve 11, e.g. via a path through the throttle valve 3'.

Then, at a step S224, a learned value (reference value) IXREF of the feedback control amount is calculated e.g. by the use of the present value IAI(n) of the integral term calculated at the step S221, e.g. according to Equation (42), followed by terminating the present routine and returning to the FIG. 39 main routine:

$$IXREF=(CXREF/65536)\times IAI(n)+[(65536-CXREF)/65536]\times IXREF(n-1) \tag{42}$$

where CXREF represents a variable set to a proper value experimentally selected from a range of 1 to 256. Further, IXREF(n−1) represents the immediately preceding value of the average value IAI obtained up to the immediately preceding loop in a range of the engine coolant temperature to which the present value of the engine coolant temperature belongs.

Thus, after executing the ICMD-determining routine, the program proceeds to a step S203 in FIG. 39, where it is determined whether or not the flag FBCAL is equal to "1". Then, if the flag FBCAL is equal to "1", which means that the control system is in the butane mass-calculating mode, the program proceeds to a step S204, where an IVAPER table is retrieved to determine a valve lift correction value IVAPER.

Figure 41:
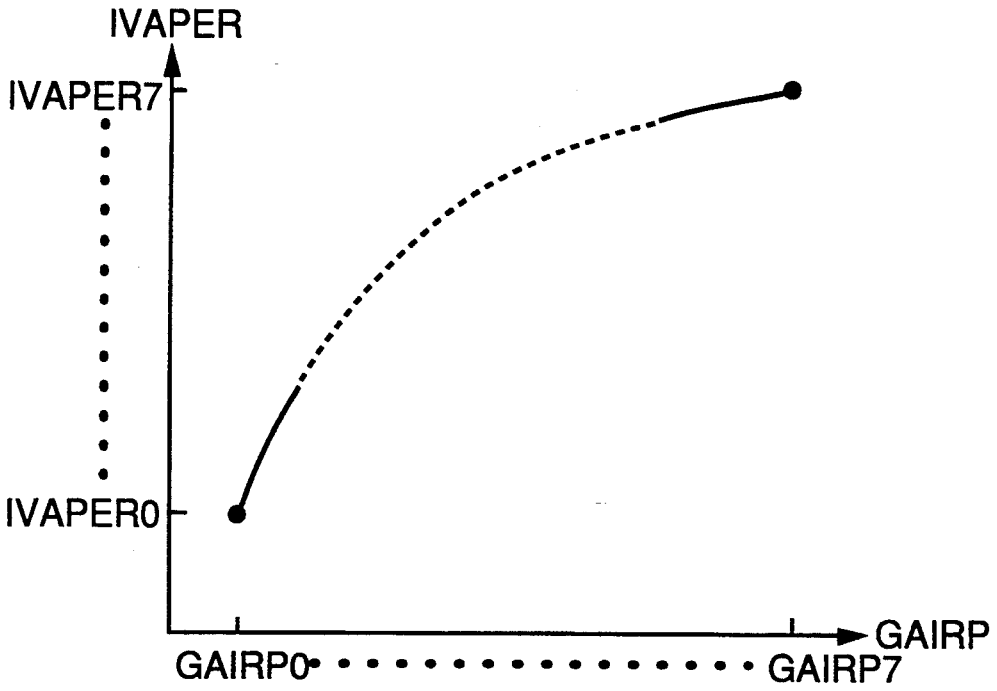
FIG. 41 shows an IVPER table.

The IVAPER table is set, e.g. as shown in FIG. 41, such that table values IVAPER0 to IVAPER7 are provided in a manner non-linearly corresponding to predetermined values GAIRP0 to GAIRP7 of the amount GAIRP of air contained in the purged gas. The valve lift correction value IVAPER is determined by retrieving the IVAPER table, and additionally by interpolation, if required.

Then, finally, the valve lift command value ICMDM for the AIC control valve 11 is calculated by the use of Equation (42), followed by terminating the program.

$$ICMDM = ICMD - IVAPER \quad (42)$$

In this manner, even if a large amount of purged gas (air+evaporative fuel) is purged from the canister 33 into the intake passage during idling of the engine, the amount of auxiliary air allowed to be drawn in through the AIC control valve 11 is decreased according to the amount GAIRP of air contained in the purged gas, which makes it possible to secure excellent performance of the engine during idling thereof.

Further, the present invention is not limited to the preferred embodiment described above by way of example. Although in the above embodiment, control of the valve lift amount of the AIC valve 11 is described in detail as means for controlling the amount of auxiliary air, this is not limitative, but the present invention may be applied to control of a fast idle control valve 44 shown in FIG. 42 in the same manner.

The fast idle control valve 44 is arranged in an auxiliary air supply pipe 46 communicating with the atmosphere via an air clear 45 and opening into the intake pipe 2. The fast idle control valve 44 comprises a valve seat 47, a valving element 48 for opening and closing the valve seat 47, a sensor 50 which is formed by a wax-type thermostat or the like and responsive to the engine coolant temperature TW for causing expansion or contraction of an atm 49, a lever 51 which is rotated according to the expansion or contraction of the atm 49 for displacing the valving element 48 in a valve-closing or valve-opening direction, a spring 52 for urging the lever 51 in the valve-opening direction, and a solenoid 53 connected to the ECU 5 for duty control of operation of the valving element 48.

Figure 42:
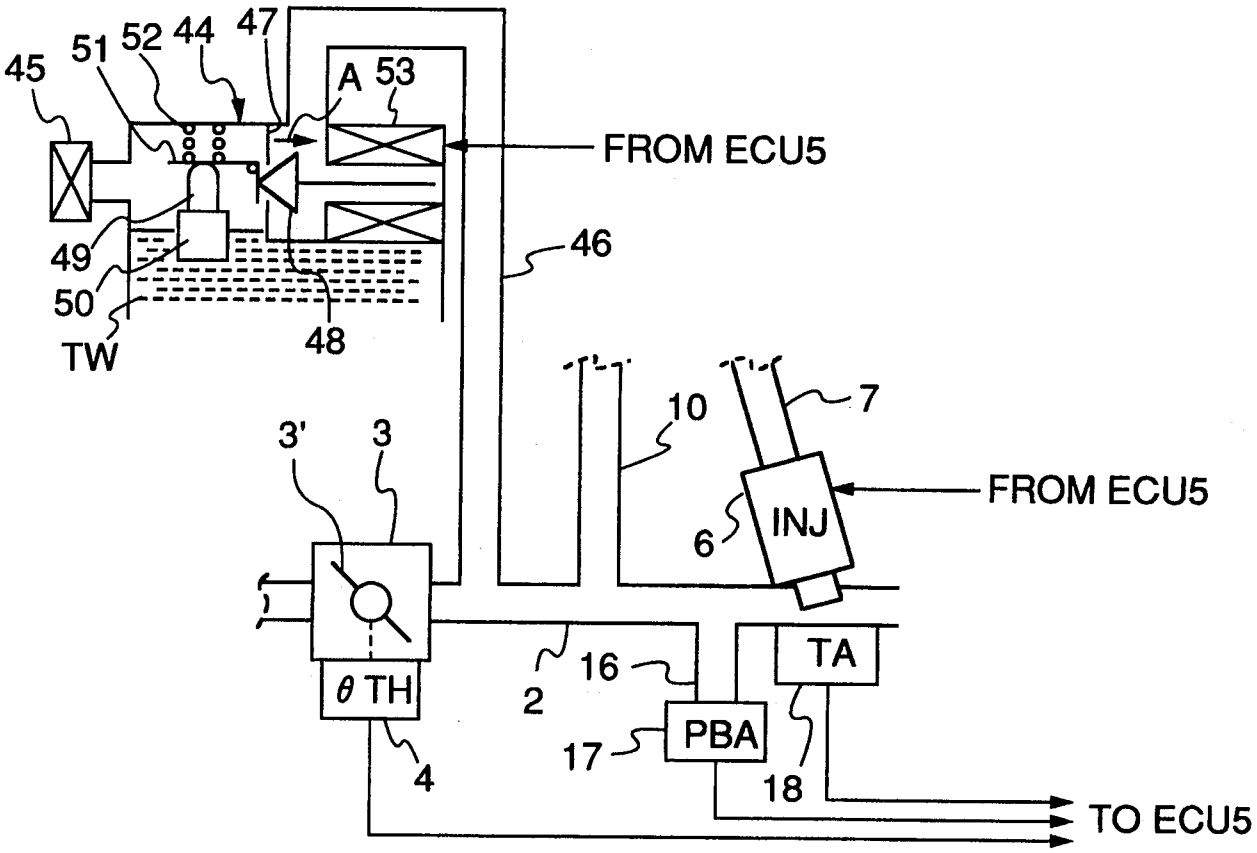
FIG. 42 is a diagram showing essential parts of an another embodiment of the invention.

In the control system for an internal combustion engine provided with the fast idle control valve 44, when the engine coolant temperature is lower than a predetermined value (e.g. 70° C.), the arm 49 of the sensor 50 is in a contracted state, and hence the lever 51 is rotated in the valve-opening direction by the urging force of the spring 52 to displace the valving element 48 rightwards as viewed in FIG. 42, i.e. in the valve-opening direction, whereby the minimum opening of the fast idle control valve 44 controllable by the solenoid 53 is set to a value larger than zero and dependent on the engine coolant temperature TW.

If a large amount of purged gas (evaporative fuel+air) is purged from the canister in this state of the fast idle control valve, a total amount of air supplied to the engine can increase more than required to cause the engine rotational speed NE to rise to an undesirable level. However, by applying the ICMDM-determining routine described with reference to FIG. 39 to control the fast idle control valve, it is possible to decrease the amount of auxiliary air supplied to the engine via the fast idle control valve, enabling prevention of the engine rotational speed from rising during idling due to a large amount of purged gases. In addition, according to the fast idle control valve 44, when the engine coolant temperature TW becomes higher than the predetermine value, the valving element 48 abuts on the valve seat 47 when the solenoid 53 is not energized (i.e. the minimum opening of the fast idle control valve 47 is set to zero) to inhibit the supply of auxiliary air from the air cleaner into the auxiliary air supply pipe 46 when the solenoid 53 is not energized.

What is claimed is:

1. A control system for an internal combustion engine having an intake passage having an inner wall surface, a fuel tank, at least one fuel injection valve, at least one combustion chamber, and an evaporative emission control system, said evaporative emission control system including a canister for adsorbing evaporative fuel generated from said fuel tank, a purging passage connecting between said intake passage and said canister, a flowmeter arranged in said purging passage for generating an output indicative of a flow rate of a gas containing said evaporative fuel and purged through said purging passage into said intake passage, and a purge control valve for controlling the flow rate of said gas, the control system comprising:

auxiliary air supply means for supplying auxiliary air to said engine, operating condition-detecting means for detecting operating conditions of said engine including at least the rotational speed of said engine and load on said engine;

purging flow rate-calculating means for calculating a value of said flow rate of said gas based on results of detection by said operating condition-detecting means;

concentration-calculating means for calculating concentration of evaporative fuel contained in said gas based on a result of calculation by said purging flow rate-calculating means and said output from said flowmeter;

purged gas volume-calculating means for calculating a volume of said gas purged over a predetermined time period, based on said output from said flowmeter;

purged gas dynamic characteristic-determining means for calculating a Datameter indicative of dynamic characteristics of said gas based on a result of detection by said operating condition-detecting means;

purged air amount-calculating means for calculating an amount of air contained in said purged gas drawn into said combustion chamber during the present cycle of operation of said engine, at least based on a result of calculation by said concentration-calculating means, a result of calculation by said purged gas volume-calculating means, and a result of calculation by said purged gas dynamic characteristic-determining means; and auxiliary air amount control means for controlling an amount of auxiliary air supplied by said auxiliary air supply means depending on a result of calculation by said purged air amount-calculating means.

2. A control system according to claim 1, wherein said auxiliary air amount control means comprises a control valve arraigned in said auxiliary air supply means and controlled based on a parameter indicative of said amount of auxiliary air, for controlling said amount of auxiliary air, basic value-determining means for determining a basic value of said parameter based on a desired idling engine rotational speed, subtraction value-determining means for determining a value of said parameter to be subtracted from said basic value of said parameter based on said amount of air contained in said purged gas calculated by said purged gas amount-calculating means, and parameter-calculating means for calculating said parameter by subtracting said subtraction value of said parameter from said basic value of said parameter.

3. A control system according to claim 1, including, first evaporative fuel amount-calculating means for calculating a total amount of evaporative fuel purged from said canister into said intake passage during a present cycle of operation of said engine, based on said result of calculation by said purged gas dynamic characteristics-calculating means and said result of calculation by said concentration-calculating means;

second evaporative fuel amount-calculating means for calculating an amount of evaporative fuel supplied to said combustion chamber of said engine during the present cycle of operation of said engine based on said total amount of evaporative fuel calculated by said first evaporative fuel amount-calculating means and said parameter indicative of said dynamic characteristics of said gas calculated by said purged gas dynamic characteristic-calculating means; and required fuel amount-determining means for determining an amount of fuel to be injected by each of said at least one fuel injection valve based on a result of calculation by said second evaporative fuel amount-calculating means.

4. A control system according to claim 2, including, first evaporative fuel amount-calculating means for calculating a total amount of evaporative fuel purged from said canister into said intake passage during a present cycle of operation of said engine, based on said result of calculation by said purged gas dynamic characteristics-calculating means and said result of calculation by said concentration-calculating means;

second evaporative fuel amount-calculating means for calculating an amount of evaporative fuel supplied to said combustion chamber of said engine during the present cycle of operation of said engine based on said total amount of evaporative fuel calculated by said first evaporative fuel amount-calculating means and said parameter indicative of said dynamic characteristics of said gas calculated by said purged gas dynamic characteristic-calculating means; and required fuel amount-determining means for determining an amount of fuel to be injected by each of said at least one fuel injection valve based on a result of calculation by said second evaporative fuel amount-calculating means.

5. A control system according to claim 1, wherein said purged gas dynamic characteristic-calculating means includes delay time-calculating means for calculating a delay time required for said evaporative fuel purged from said canister to reach said combustion chamber after leaving said canister, direct evaporative fuel supply amount-calculating means for estimating an amount of evaporative fuel directly supplied to said combustion chamber, out of an amount of evaporative fuel purged into said intake passage during the present cycle of operation of said engine, and carry-off evaporative fuel supply amount-calculating means for estimating an amount of evaporative fuel carried off from evaporative fuel staying in said purging passage and said intake passage into said combustion chamber during the present cycle of operation of said engine.

6. A control system according to claim 2, wherein said purged gas dynamic characteristic-calculating means includes delay time-calculating means for calculating a delay time required for said evaporative fuel purged from said canister to reach said combustion chamber after leaving said canister, direct evaporative fuel supply amount-calculating means for estimating an amount of evaporative fuel directly supplied to said combustion chamber, out of an amount of evaporative fuel purged into said intake passage during the present cycle of operation of said engine, and carry-off evaporative fuel supply amount-calculating means for estimating an amount of evaporative fuel carried off from evaporative fuel staying in said purging passage and said intake passage into said combustion chamber during the present cycle of operation of said engine.

7. A control system according to claim 3, wherein said purged gas dynamic characteristic-calculating means includes delay time-calculating means for calculating a delay time required for said evaporative fuel purged from said canister to reach said combustion chamber after leaving said canister, direct evaporative fuel supply amount-calculating means for estimating an amount of evaporative fuel directly supplied to said combustion chamber, out of an amount of evaporative fuel purged into said intake passage during the present cycle of operation of said engine, and carry-off evaporative fuel supply amount-calculating means for estimating an amount of evaporative fuel carried off from evaporative fuel staying in said purging passage and said intake passage into said combustion chamber during the present cycle of operation of said engine.

8. A control system according to claim 4, wherein said purged gas dynamic characteristic-calculating means includes delay time-calculating means for calculating a delay time required for said evaporative fuel purged from said canister to reach said combustion chamber after leaving said canister, direct evaporative fuel supply amount-calculating means for estimating an amount of evaporative fuel directly supplied to said combustion chamber, out of an amount of evaporative fuel purged into said intake passage during the present cycle of operation of said engine, and carry-off evaporative fuel supply amount-calculating means for estimating an amount of evaporative fuel carried off from evaporative fuel staying in said purging passage and said intake passage into said combustion chamber during the present cycle of operation of said engine.

9. A control system according to claim 5, wherein said direct evaporative fuel supply amount-calculating means and said carry-off evaporative fuel supply amount-calculating means estimate, respectively, said amount of evaporative fuel directly supplied to said combustion and said amount of evaporative fuel carried off from evaporative fuel staying in said purging passage and said intake passage into said combustion chamber, in a manner depending on said delay time calculated by said delay time-calculating means.

10. A control system according to claim 6, wherein said direct evaporative fuel supply amount-calculating means and said carry-off evaporative fuel supply amount-calculating means estimate, respectively, said amount of evaporative fuel directly supplied to said combustion and said amount of evaporative fuel carried off from evaporative fuel staying in said purging passage and said intake passage into said combustion chamber, in a manner depending on said delay time calculated by said delay time-calculating means.

11. A control system according to claim 7, wherein said direct evaporative fuel supply amount-calculating means and said carry-off evaporative fuel supply amount-calculating means estimate, respectively, said amount of evaporative fuel directly supplied to said combustion and said amount of evaporative fuel carried off from evaporative fuel staying in said purging passage and said intake passage into said combustion chamber, in a manner depending on said delay time calculated by said delay time-calculating means.

12. A control system according to claim 8, wherein said direct evaporative fuel supply amount-calculating means and said carry-off evaporative fuel supply amount-calculating means estimate, respectively, said amount of evaporative fuel directly supplied to said combustion and said amount of evaporative fuel carried off from evaporative fuel staying in said purging passage and said intake passage into said combustion chamber, in a manner depending on said delay time calculated by said delay time-calculating means.

* * * * *